US009002628B2

(12) United States Patent
Wilder et al.

(10) Patent No.: US 9,002,628 B2
(45) Date of Patent: Apr. 7, 2015

(54) AERONAUTICAL HOLDING PATTERN CALCULATION FOR SOLVING HIGH WIND AND PROTECTED AIRSPACE ISSUES

(71) Applicant: Epoch Flight Systems LLC, Frisco, TX (US)

(72) Inventors: Bruce Gary Wilder, Frisco, TX (US); Otto Charles Wilke, Waco, TX (US)

(73) Assignee: Epoch Flight Systems LLC, Frisco, TX (US)

( * ) Notice: Subject to any disclaimer, the term of this patent is extended or adjusted under 35 U.S.C. 154(b) by 0 days.

(21) Appl. No.: 14/193,542

(22) Filed: Feb. 28, 2014

(65) Prior Publication Data

US 2014/0257684 A1 Sep. 11, 2014

Related U.S. Application Data

(63) Continuation-in-part of application No. 13/794,723, filed on Mar. 11, 2013, now Pat. No. 8,700,317.

(51) Int. Cl.
*G08G 5/00* (2006.01)

(52) U.S. Cl.
CPC ..... *G08G 5/006* (2013.01); *G08G 5/0052* (2013.01); *G08G 5/0078* (2013.01)

(58) Field of Classification Search
CPC ..... G08G 5/006
USPC ..... 701/116, 120, 121, 122
See application file for complete search history.

(56) References Cited

U.S. PATENT DOCUMENTS 5,553,387 A * 9/1996 Newcomb ..... 33/1 SD
6,405,107 B1 * 6/2002 Derman ..... 701/3
6,678,587 B2 * 1/2004 Miller ..... 701/410
7,003,383 B2 * 2/2006 Rumbo et al. ..... 701/410
7,152,332 B1 * 12/2006 Jain et al. ..... 33/1 SD
7,370,790 B2 * 5/2008 Martincikova et al. ..... 701/3

(Continued)

FOREIGN PATENT DOCUMENTS

EP 1764759 A1 * 3/2007
JP 07104853 A 4/1995

OTHER PUBLICATIONS

Universal Avionics Systems Corporation Operator's Training Manual 80X/90X, Report No. 3040sv80X/90X, Oct. 1, 2009, Univversal Avionics Systems Corporation, Tuscon, Azrizona, Cover page, p. 15 and pp. 123 thru 138.*

(Continued)

*Primary Examiner* — Tuan C. To
*Assistant Examiner* — Dale W Hilgendorf
(74) *Attorney, Agent, or Firm* — Conley Rose, P.C.; Grant Rodolph

(57) ABSTRACT

An apparatus comprising a memory and a processor coupled to the memory, wherein the processor is configured to receive holding instructions for an aircraft, wherein the holding instructions comprise a holding fix, a holding direction, and an inbound leg course, obtain an airspeed for the aircraft, obtain a wind speed and a wind direction affecting the aircraft, calculate a holding pattern for the aircraft using the holding instructions, the wind speed, the wind direction, an inbound leg duration, and the airspeed, obtain Federal Aviation Administration (FAA) protected airspace limits associated with the holding fix, and present the holding pattern and the FAA protected airspace limits to a flight crew member on the aircraft.

28 Claims, 24 Drawing Sheets

(56) References Cited

U.S. PATENT DOCUMENTS

| | | | | |
|---|---|---|---|---|
| 7,630,829 | B2 | 12/2009 | Pepitone | |
| 7,903,000 | B2 * | 3/2011 | Hammack et al. | 701/14 |
| 8,234,058 | B1 | 7/2012 | Barber et al. | |
| 8,244,453 | B2 | 8/2012 | Lacombe et al. | |
| 2004/0073571 | A1 * | 4/2004 | Kumhyr et al. | 707/104.1 |
| 2010/0280753 | A1 * | 11/2010 | Chytil et al. | 701/208 |
| 2011/0313597 | A1 * | 12/2011 | Wilson et al. | 701/3 |
| 2012/0130626 | A1 | 5/2012 | Klooster et al. | |

OTHER PUBLICATIONS

Universal Avionics System Corporation Operator's Training Manual 80X/90X, Report No. 3040sv80X/90X, Oct. 1, 2009, Univeral Avionics System Corporation, Tucson, Arizona, Cover page, 15, and 123-138.*

Notice of Allowance dated Nov. 29, 2013, 12 pages, U.S. Appl. No. 13/794,723, filed Mar. 11, 2013.

Office Action dated Aug. 12, 2013, 29 pages, U.S. Appl. No. 13/794,723, filed Mar. 11, 2013.

"Holding Pattern Criteria," Federal Aviation Administration, Department of Transportation, 7130.3A, Mar. 18, 1998, 61 pages.

"Instrument Flying Handbook (FAA-H-8083-15B) Note," U.S. Department of Transportation, Federal Aviation Administration, Flight Standards Service, 2012, pp. 1-4, 301-304, and 346-365.

"Aeronautical Information Manual," Change 2, Mar. 7, 2013, U.S. Department of Transportation, Federal Aviation Administration, Jul. 7, 2012, pp. 3, 338-344 and 617-733.

"Instrument Procedures Handbook," FAA-H-8261-1A, U.S. Department of Transportation, Federal Aviation Administration, 2007, Cover pp. 2, pp. 1-4, 100-102, 123-124, and 274-287.

"Operator's Training Manual for FMS and MMS 1E, 1Esp, 1F, & 1L, 1C+, 1Csp+, 1D+, & 1K+, Covering SCN-801, 802 & 803 with Multi Mission Management System (MMMS) 90X Series," Universal Avioncs System Corporation, 80X/90X, Report No. 3040sv80X/80x, Oct. 1, 2007, 420 pages.

* cited by examiner

AERONAUTICAL HOLDING PATTERN CALCULATION FOR SOLVING HIGH WIND AND PROTECTED AIRSPACE ISSUES

CROSS-REFERENCE TO RELATED APPLICATIONS

The present application is a continuation-in-part of U.S. patent application Ser. No. 13/794,723 filed Mar. 11, 2013 by Bruce Wilder et al. and entitled "Aeronautical Holding Pattern Calculation for Solving High Wind and Protected Airspace Issues," which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The present disclosure relates to using electronic devices for improved calculations of Federal Aviation Administration (FAA) published or FAA Air Traffic Control assigned aeronautical holding patterns. There have been previous efforts to determine holding patterns for aircraft. For example, U.S. Pat. No. 3,110,965, issued on Nov. 19, 1963, to James A. Kittock, discloses a device to aid pilots in entering and maintaining a holding pattern from a preset holding fix. It is not a method using an electronic device, but is an entry calculator (for tear drop, parallel and direct entries), and has no wind corrections.

U.S. Pat. No. 4,182,171, issued on Jan. 8, 1980, to Ivan L. Looker, discloses an aircraft navigation device that aids a pilot in flying holding patterns. Although it includes very high frequency omnidirectional range (VOR) radio receivers, it is not a method using an electronic device, does not calculate a heading, and does not calculate wind corrections.

U.S. Pat. No. 4,274,204, issued on Jun. 23, 1981, to Freddy R. Self, discloses an aircraft pattern computer, that is a mechanical device, rather than a method using an electronic device, and is primarily a traffic pattern calculator, not a holding pattern calculator, and does not calculate outbound heading or wind corrections.

U.S. Pat. No. 6,167,627, issued on Jan. 2, 2001, to Bruce Gary Wilder and Otto Charles Wilke, discloses an aeronautical holding pattern calculator, having both mechanical and electronic embodiments.

U.S. Pat. No. 6,678,587, issued on Jan. 13, 2004, to Ronald J. Miller, discloses a system for a tanker plane entering a rendezvous orbit with a plane to be refueled, that includes entering a holding pattern. It is designed for military operations, and for airspace that is designed specifically for an air refueling mission, not for civilian holding patterns.

U.S. Pat. No. 6,847,866, issued on Jan. 25, 2005, to Chad E. Gaier, discloses shortened aircraft holding patterns using a flight management system (FMS). It is for exiting a hold, not staying in the hold, and it does not indicate whether you are within the limits of FAA protected airspace.

U.S. Pat. No. 7,003,383, issued on Feb. 21, 2006, to Jim R. Rumbo et al., discloses a flight management system using holding pattern entry algorithms. Its algorithms are specifically for hold entries (teardrop, parallel and direct) and it does not account for FAA holding space parameters.

U.S. Pat. No. 7,152,332, issued on Dec. 26, 2006, to Ashish Kumar Jain and Gerald Lamar Miley, discloses a navigational assist system for determining entry procedures for holding and runway traffic patterns. It is a simplistic mechanical device, rather than a method using an electronic device that calculates outbound headings and wind corrections, and depicts holding space limits.

U.S. Pat. No. 7,370,790, issued on May 13, 2008, to Jan Martincik and Jana Martincikova, discloses an apparatus for visualizing and determining a holding pattern and entry procedure. It is a mechanical device, rather than a method using an electronic device. It is a visual aid to identify the quadrant the plane is flying in for teardrop, parallel and direct holding pattern entries. It neither corrects for wind nor provides information on an outbound heading or airspace.

U.S. Pat. No. 7,903,000, issued on Mar. 8, 2011, to Jason L. Hammack et al., discloses a system for representing a holding pattern on a vertical situation display. It does not show a wind compensated holding pattern and FAA protected airspace.

U.S. Pat. No. Des. 377,942, issued on Feb. 11, 1997, to John K. McCloy, discloses a design for a multi-layer rotary holding pattern entry calculator. Again, it is a mechanical device, rather than a method for using an electronic device. It is for entry information only, not the hold itself. It does no wind or heading calculations.

U.S. Patent Application Publication No. 2009/0319100, issued on Dec. 24, 2009, to Nitin Anand Kale and Keshav Rao, discloses systems and methods for defining and rendering a trajectory of an aircraft. It may be used for holding patterns. It may re-label a way point as a holding way point. It does not calculate holding patterns to stay within depicted FAA holding airspace.

Japanese Patent No. 7-104853, published on Apr. 21, 1995, inventors Takashi Oki, Masahiro Hattori and Naoyuki Yamashita, discloses an automatically guided flight system for an airplane, capable of following an airplane in a turning course while holding a turning radius. It does not appear to be designed to calculate holding patterns.

SUMMARY

In one embodiment, the disclosure includes an apparatus comprising a memory and a processor coupled to the memory, wherein the processor is configured to receive holding instructions for an aircraft, wherein the holding instructions comprise a holding fix, a holding direction, and an inbound leg course, obtain an airspeed for the aircraft, obtain a wind speed and a wind direction affecting the aircraft, calculate a holding pattern for the aircraft using the holding instructions, the wind speed, the wind direction, an inbound leg duration, and the airspeed, obtain Federal Aviation Administration (FAA) protected airspace limits associated with the holding fix, and present the holding pattern and the FAA protected airspace limits to a flight crew member on the aircraft.

In another embodiment, the disclosure includes a computer program product comprising computer executable instructions stored on a non-transitory computer readable medium that when executed by a processor causes a flight management system (FMS) to perform the following: receive holding instructions for an aircraft, wherein the holding instructions comprise a holding fix, a holding direction, and an inbound leg course; obtain an airspeed for the aircraft; obtain a wind speed and a wind direction; calculate a holding pattern for the aircraft using the holding instructions, the wind speed, the wind direction, an inbound leg duration, and the airspeed; obtain protected airspace limits associated with the holding fix; determine whether the holding pattern is within the protected airspace limits, and notify a flight crew member the determination indicating whether the holding pattern is within the protected airspace limits.

In yet another embodiment, the disclosure includes an aircraft comprising an airframe, at least one engine attached to the airframe, an avionics system attached to the airframe, and an FMS attached to the airframe and in communication with the avionics system, wherein the FMS receives holding instructions for an aircraft, wherein the holding instructions comprise a holding fix, a holding direction, and an inbound leg course, obtains an airspeed for the aircraft from the avionics system, obtains a wind speed and a wind direction affecting the aircraft, calculates a holding pattern for the aircraft using the holding instructions, the wind speed, the wind direction, an inbound leg duration, and the airspeed, obtains FAA protected airspace limits associated with the holding fix, and displays the holding pattern and the FAA protected airspace limits to a flight crew member on the aircraft through either the FMS or the avionics system.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
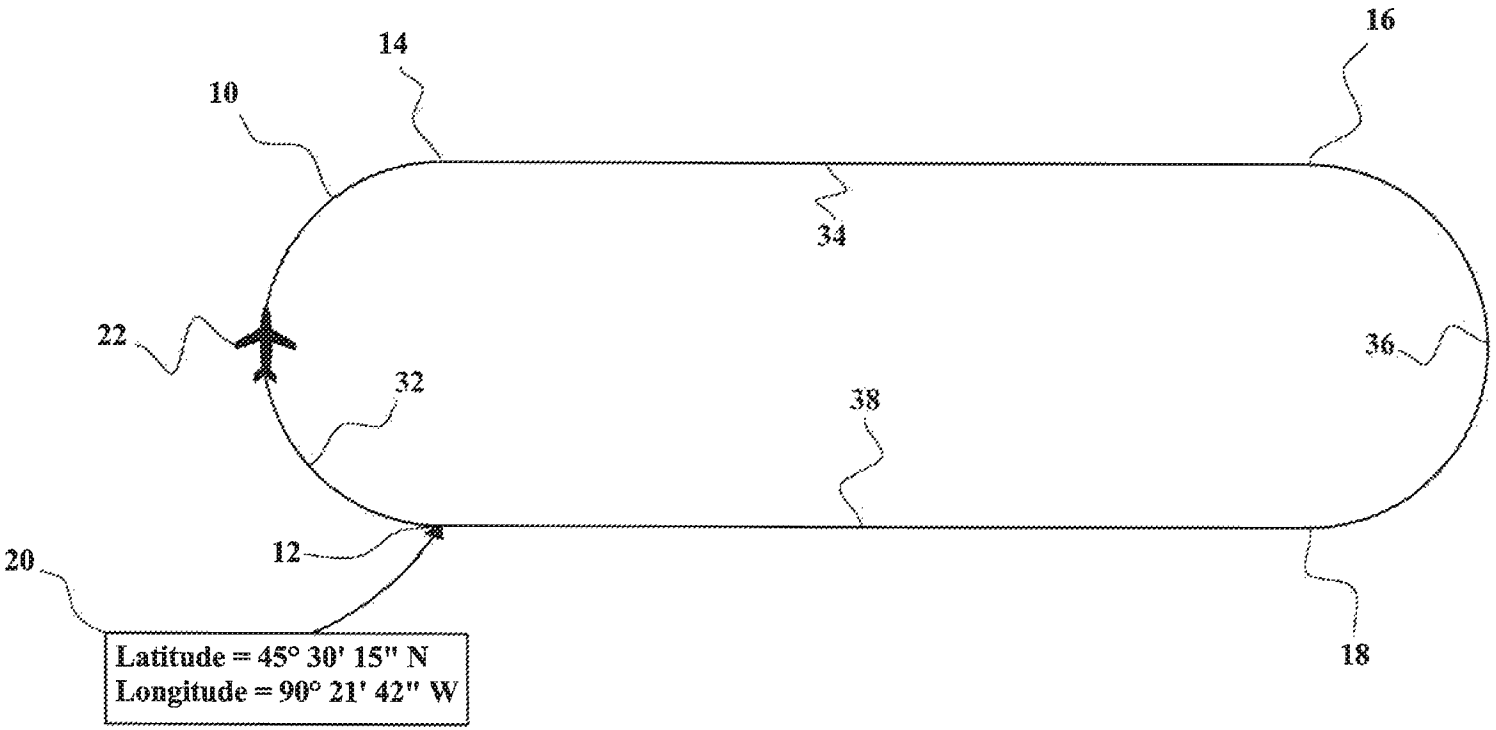
FIG. 1 is graphical representation of a holding pattern using an embodiment disclosed herein.

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are systems, methods, apparatuses, and computer program products for improved calculations of aeronautical holding patterns while staying within FAA protected airspace. The present disclosure may employ a calculator as (or with) a stand-alone electronic device or link it to a smart phone, iPad, tablet or laptop computer, flight management system (FMS) or any other digital electronic media used in aircraft or unmanned aerial vehicle (UAV) navigation or flight planning.

Navigational way points such as global positioning system (GPS) waypoints, named fixes, user defined way points, very high frequency omnidirectional range (VOR), VOR/distance measuring equipment (DME), tactical air navigation (TACAN), non-directional radio beacon (NDB), NDB/VOR, intersecting VOR radials, VOR radials at DME distances, and marker beacons may be defined using their latitude and longitude coordinates. The latitude and longitude that define the point for the turn inbound may be displayed as a bearing or distance along a radial, or both.

A bearing may be identified using VOR needles, horizontal situation indicator (HSI) needles, radio magnetic indicator (RMI) needles, automatic direction finder (ADF) needles, or FMS bearing pointers. Additionally, the FMS or flight calculator may automatically calculate the turning point inbound based on the mentioned navigation algorithms and procedures. It may then command a turn, based on the same algorithms, through the automatic flight control system (AFCS or autopilot) or flight director if flown manually, e.g. at the standard rate of 3 degrees of turn per second or as limited by the manufacturer, to remain in the protected airspace and roll out on the correct inbound course.

A navigation aid (NAVAID) may be any visual or electronic device, airborne or on the surface, which provides point-to-point guidance information or position data to an aircraft (e.g. airplane, helicopter, etc.) in flight. NAVAIDs may send out radio signals that the aircraft's tuned receiver picks up. The signals may then be tracked using radials or bearings. A waypoint is a reference point in physical space used for navigation. It can be a VOR or GPS identified point. All have longitude and latitude identifiable positions along with a name.

An inbound leg course may be a straight-line path of flight, e.g., having an inbound leg duration of one to one and a half (1.5) minutes, that ends at a position called a holding fix (or just "fix"). As the aircraft passes over the holding fix, the pilot begins the outbound turn by banking the aircraft to a bank angle, e.g. the bank angle required to produce a standard rate turn. As the aircraft approaches a specified outbound heading, the pilot levels the aircraft and flies on that heading until the bearing back to the NAVAID is a specified value. He then banks the aircraft to the same bank angle as before, beginning the inbound turn and continues that turn until the aircraft reaches the start of the inbound leg. The pilot then levels the wings and uses a defined wind corrected heading to fly the inbound course to the fix and repeats the entire process, until given instructions to proceed from the hold.

The four posts of a holding pattern are the four positions at which changes in flight are made; they are the end of the inbound leg, the end of the outbound turn, the end of the outbound leg, and the beginning of the inbound leg. The holding fix may be the only identifiable post in timed holding. Timing of the outbound leg starts abeam the fix or when the wings are level after the turn, whichever comes later. Timing of the inbound leg starts with wings level. The end of the outbound leg may be identified using a bearing or distance measuring equipment (DME) distance along a radial.

The four posts of a holding pattern may be defined onto the depicted, wind corrected holding pattern selected. The actual holding space dimensions may be viewable in relation to the hold and non-protected airspace. FIG. 1 shows a holding pattern 10, with the four posts 12, 14, 16 (the holding fix) and 18, the inbound turn 32 between 12 and 14, the inbound leg 34 between 14 and 16, the outbound turn 36 between 16 and 18, the outbound leg 38 between 18 and 12, and the latitude and longitude 20 of the holding fix 12.

The holding pattern may be drawn to the correct shape with regards to the prevailing winds (defined by wind direction and velocity). This shape may be represented within the protected holding pattern airspace. This pictorial display may also be used as an overlay to show the pilot actual representation of terrain associated with the hold. A moving target 22 representing the aircraft (shown in FIG. 1) may also be displayed showing the pilot the aircraft's position throughout the hold.

The FAA has defined protected airspace for each holding fix. The protected airspace varies depending on many factors, but is larger than the holding pattern under no-wind conditions to allow the aircraft to modify the holding pattern to adjust to various wind conditions and still meet the specified duration and course on the inbound leg. Variable airspeeds may be used with the wind calculations to maintain the aircraft within FAA protected airspace limits. Standard Federal Aviation Administration (FAA), International Civil Aeronautics Organization (ICAO), military holding airspeeds, and altitudes may be applied during the calculations of algorithms. With a given bank angle, and starting from a maximum airspeed for a given altitude, three patterns may be displayed. The airspeed for the first pattern may indicate the maximum holding airspeed for that altitude. The second pattern may indicate the maximum airspeed minus 15%, and the third pattern may indicate maximum airspeed minus 30%. The variable airspeed may solve the problem of wind speed to aircraft speed, being outside of a defined workable solution where the wind speeds are equal to 25% or more of the aircraft's speed. If the aircraft is flying too fast or the wind speeds are too great to remain within the protected holding airspace, a message may be generated to notify the pilot that the aircraft may not remain inside the protected airspace limits. In some embodiments, it may not be possible to fly a traditional racetrack style holding pattern and remain within the FAA protected airspace when wind speed exceeds about 25% of the aircraft's airspeed. In such cases, a figure-eight style holding pattern may be used, as discussed below. In some embodiments, it may not be possible to fly a traditional figure eight style holding pattern and remain within the FAA protected airspace when wind speed exceeds about 83% of the aircraft's airspeed.

Figure 2:
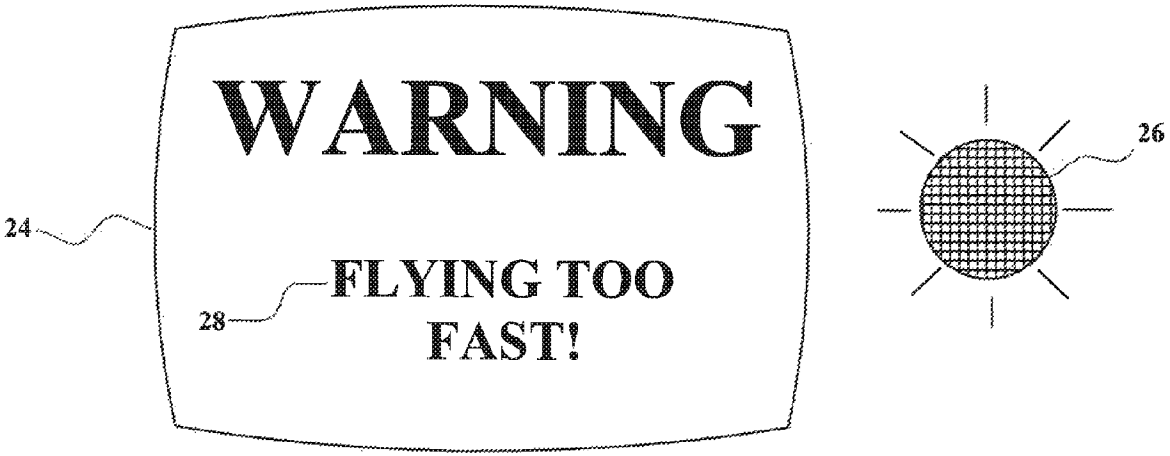
FIG. 2 is graphical representation of a warning regarding flight speed given by an embodiment disclosed herein.
Figure 3:
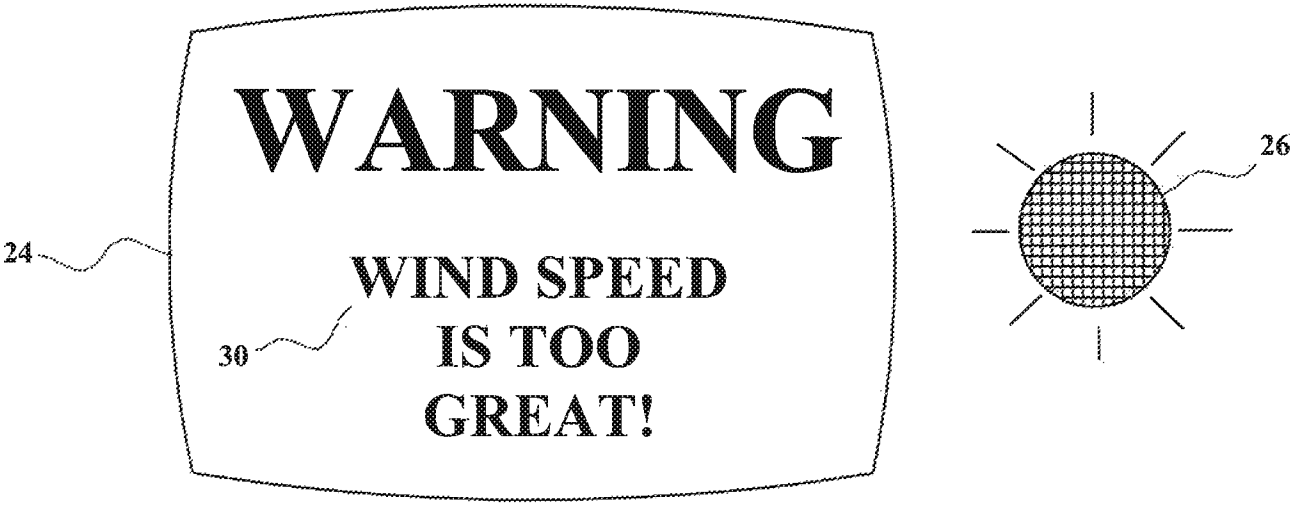
FIG. 3 is a graphical representation of a warning regarding wind speed given by an embodiment disclosed herein.

FIG. 2 shows a screen 24 on which a warning regarding flight speed 28 is displayed. A speaker 26 may also give an audible warning 26. FIG. 3 shows a warning regarding wind speed 30. For aircraft utilizing an FMS, current information may be taken from the aircraft's onboard computers and sensors (e.g. avionics systems) and applied to the aircraft's current position.

The FAA has specified the extents and shapes of areas the aircraft must remain within to be within the holding space dimensions. These FAA protected airspace limits (sometimes referred to as envelopes) may vary with altitude and airspeed and are constructed using compasses and rulers. There are many such envelopes. In an exemplary program, the shape of an envelope may be represented by two straight lines and two semi-circles. If an aircraft remains within the envelope, it may also be inside the FAA envelope for that altitude and speed. If a aircraft is outside the FAA envelope, it is in non-protected airspace.

In an embodiment, an FMS on the aircraft may determine whether a holding pattern is within the FAA protected airspace limits. The system may notify a flight crew member to take corrective action when at least part of the holding pattern is not within the FAA protected airspace limits. The corrective action may be any suitable action pre-designed by the FAA or the system of the aircraft. For example, when at least part of the calculated holding pattern is not within the FAA protected airspace limits, the FMS may determine whether a different airspeed (e.g., an increased or decreased airspeed) will keep the holding pattern within the FAA protected airspace limits.

In an embodiment, when the different airspeed will indeed keep the holding pattern within the FAA protected airspace limits, the FMS may further recalculate the holding pattern for the aircraft using the holding instructions, the wind speed, the wind direction, the inbound leg duration, and the different airspeed. The recalculated holding pattern may be presented to the flight crew member. Then, the FMS may instruct the flight crew to change the airspeed to the different airspeed.

In some cases, there is not a suitable holding airspeed between a minimum hold speed (e.g. the stall speed or $V_S$) for the aircraft and a maximum hold speed (e.g. the never exceed speed or $V_{NE}$) for the aircraft to keep the holding pattern (and hence the aircraft) within the FAA protected airspace limits. In this case, the FMS may change the holding pattern from a racetrack-style holding pattern to a figure eight holding pattern. Note that the racetrack-style holding pattern may resemble a racetrack in the sense that the pattern does not intersect itself, while the figure eight holding pattern resembles an Arabic number "8" in the sense that the pattern intersects itself. Then, the FMS may calculate the figure-eight holding pattern for the aircraft using the holding instructions, the wind speed, the wind direction, and the inbound leg duration. The FMS may further present the recalculated holding pattern to the flight crew member.

Maximum allowed holding pattern airspeeds may be as specified in Holding Pattern Criteria, paragraphs 2-8.a or 2-8.b, as applicable, pursuant to FAA Order 7130.3A, including all modifying FAA Memoranda, or its successor regulations. Use Table 1: Maximum Holding Airspeeds, page 2-2, FAA Order 7130.3A, including all modifying FAA Memoranda, or its successor regulations, with the "airplane type" input (described below) to identify the maximum allowed holding pattern airspeed. Use Table 2: Holding Pattern Selection Chart, pages 2-3 through 2-5, FAA Order 7130.3A, including all modifying FAA Memoranda, or its successor regulations, with the maximum allowed holding pattern airspeed from Table 1 and the inputs for FIX-to-NAVAID distance and holding altitude to identify the FAA template to apply to the holding pattern. The full size of the holding pattern for holding patterns in a location and at an altitude as published by the FAA or as assigned by FAA Air Traffic Control, may be evaluated for obstacle clearance in accordance with the FAA Order 7130.3A, including all modifying FAA Memoranda, paragraph 2-5, or its successor regulations. Left and right hand turns in holding patterns in FAA template tracing may be accounted for in accordance with FAA Order 7130.3A, including all modifying FAA Memoranda, paragraphs 2-30.a and 2-30.b, or its successor regulations.

The inbound leg may be defined by the holding instructions and the airspeed. The end of the inbound is the holding fix. The start of the inbound leg may be determined using the holding fix, the inbound leg course, the duration of the inbound leg (e.g. 1 or 1.5 minutes), and the airspeed. Specifically, the start of the inbound leg may be determined by multiplying the airspeed by the duration to get a distance, and then projecting that distance down the reciprocal of the inbound leg course from the holding fix. For example, if the inbound course is 270 degrees, the hold time is one minute, and the airspeed is 180 knots, the start of the inbound leg will be 3 nautical miles (nm) east of the holding fix (180 knot (nm/hour)×1 minute×(1 hour/60 minutes)=3 nm; the reciprocal of 270 degrees is 090 degrees or due east).

The outbound turn may be determined by predicting the aircraft's flight path when turning. Beginning at the end of the inbound leg (the fix) and triangulating once per second or at any other interval, the program may generate an entire 360-degree turn using a selected rate of turn (e.g. a standard rate turn or steeper turn if needed) and airspeed. The generated curved path trajectory is generally spiral-shaped and may represent the predicted ground track of the aircraft as it turns 360 degrees in the air from the holding course, and includes the effect the wind has on the aircraft's ground track. The curve may be positioned such that a point on the curve (e.g. the starting point of the curve) is located at the holding fix. Generally, the inbound course will be tangent to the curve when the curve is located at the holding fix. As discussed below, a portion of the curve will form the outbound turn of the holding pattern.

The inbound turn may be also be determined by predicting the aircraft's flight path when turning. Specifically, the curve generated for the outbound turn may be translated such that a point on the curve is located at the start of the inbound leg such that the inbound course is tangent to the curve. Alternatively, the program may generate a new 360-degree turn using a selected rate of turn (e.g. a standard rate turn or steeper turn if needed) and airspeed. As with the outbound turn, the generated curved path trajectory may represent the predicted ground track of the aircraft as it turns 360 degrees in the air, and includes the effect the wind has on the aircraft's ground track. In such a case, the new curve may be translated such that a point on the curve is located at the start of the inbound leg such that the inbound course is tangent to the curve. As discussed below, a portion of either of these translated curves will form the inbound turn of the holding pattern.

The outbound leg determines how much of the two curves will form the outbound and inbound turns. Specifically, a search routine may be used to locate the two points at which a straight line is tangent to both curves, but is not coincident with the inbound leg. In some embodiments, outbound leg may be determined by finding a point on each curve where the slope of the tangent of each curve is equal in value and coincident. The straight line that is tangent to both curves is the outbound leg, which extends from the point where this tangent line intersects the outbound turn curve to the point where this tangent line intersects the inbound turn curve. Because positions and bearings are known for all points on both curves, the program reports the bearing at the start of the outbound leg and calculates the bearing back to the holding fix or NAVAID at the end of the outbound leg and that position is the start of the inbound turn. The unused portion of the outbound turn curve (e.g. the portion extending past the outbound leg) and the unused portion of the inbound turn curve (e.g. the portion up to the outbound leg) may not be flown or otherwise used, and hence may not be displayed to the flight crew. All of the above calculations may be performed and the resulting holding pattern and FAA envelope may be displayed to the flight crew prior to arriving at the holding fix.

When using triangulation to determine the path of an aircraft relative to the ground, the input values include bearing, altitude-corrected airspeed, wind speed, and wind bearing. In an embodiment, the term "spiral path" may be defined as a curved path trajectory with a varying radius of curvature. The spiral path generated includes the effect of wind. In some embodiments, a spiral path may simply be a circular path translated over time by the wind according to the wind speed and direction. Thus, the spiral path may have a radius that is relatively constant; however, spiral paths with continuously (or for the most part) increasing radius, e.g. turns made away from the wind, or continuously (or for the most part) decreasing radius, e.g. turns made into the wind, are not excluded. The FAA specifies maximum airspeeds for holding patterns. Those vary with the type of aircraft and with altitude. The FAA also limits bank angles. Holding patterns that are smaller are more likely to remain within protected space, with slower airspeeds and greater bank angles. The program allows the pilot to select a bank angle and produces patterns for several airspeeds equal to and less than the FAA maximum. The patterns may be displayed graphically on the computer screen with the appropriate FAA envelope. The pilot can then visually select a pattern that remains within the protected space. If none do, he can rerun the program using a greater bank angle. Alternatively, the FMS can merely provide the flight crew with an indication (e.g. a visual marker or indicia) that the FMS has determined that the holding pattern is within the FAA envelope.

Using a known formula and the specified altitude, altitude-corrected airspeeds are calculated from instrument-indicated airspeeds. The altitude-corrected airspeeds are used in the triangulation process along with other inputs to generate the path of the aircraft relative to the ground.

The computer program may generate a plot for each of several airspeeds. Each graph shows the path of the aircraft and the FAA envelope. The pilot can see visually where the path of the aircraft exits the envelope. He then selects a pattern that does not exit protected space and flies at that airspeed.

The electronic holding pattern calculator may use trigonometry, arrays, tables, or any other method to perform the above algorithm. However, the electronic holding pattern calculator may not be limited to solving the mathematical algorithms using these methods. As technology advances and better digital electronic computing devices are developed, the holding pattern calculator may utilize any technology to calculate a holding pattern in real time without the use of tables and arrays by using the increased computing power of such devices. Some of these capabilities may include and not be limited to: real-time data inputs provided by the FMS instead of user prompted inputs, and automatically determining whether the hold needs to be one minute or one and half minutes inbound based on the current aircraft altitude.

It should be noted that the above approach to calculating the holding pattern is non-iterative as long as the wind information is accurate. In other words, the pilot does not have to recompute the holding pattern or make any adjustments as long as the wind information is accurate. If the wind or any other information changes, the calculator or the FMS can receive the updated information and recompute the holding pattern using the updated information.

In an embodiment of the present disclosure, the pilot uses the FMS by inputting information to the computer and executing the program. He then selects one of the generated patterns to fly. The FMS may not be a navigation system in itself. Rather, it may be a system that automates the tasks of managing the onboard navigation systems. The FMS may also perform other onboard management tasks.

The FMS disclosed herein may be an interface between flight crews and flight-deck systems. The FMS can be thought of as a computer with a large database of airport and NAVAID locations and associated data, aircraft performance data, airways, intersections, departure procedures (DPs), and standard terminal arrival routes (STARs). The FMS also has the ability to accept and store numerous user-defined waypoints, flight routes consisting of departures, waypoints, arrivals, approaches, alternates, etc. The FMS can quickly define a desired route from the aircraft's current position to any point in the world, perform flight plan computations, and display the total picture of the flight route to the crew.

The FMS also has the capability of controlling (selecting) VOR, DME, and localizer (LOC) NAVAIDs, and then receiving navigational data from them. Inertial navigation system (INS), long range navigation (LORAN), and GPS navigational data may also be accepted by the FMS computer. The FMS may act as the input/output device for the onboard navigation systems, so that it becomes the "go-between" for the crew and the navigation systems.

At startup, the crew programs the aircraft location, departure runway, DP (if applicable), waypoints defining the route, approach procedure, approach to be used, and routing to an alternate. This may be entered manually, be in the form of a stored flight plan, or be a flight plan developed in another computer and transferred by disk or electronically to the FMS computer. The crew enters this basic information in the control/display unit (CDU). Once airborne, the FMS computer channels the appropriate NAVAIDs and takes radial/distance information, or channels two NAVAIDs, taking the more accurate distance information. FMS then indicates position, track, desired heading, groundspeed and position relative to desired track. Position information from the FMS updates the INS. In more sophisticated aircraft, the FMS provides inputs to the horizontal situation indicator (HIS), radio-magnetic indicator (RMI), glass cockpit navigation displays, head-up display (HUD), autopilot, and autothrottle systems.

Once the input information has been entered, depending on computer speed, the program calculates and displays the several patterns prior to arriving at the holding fix. An automated surface observing system (ASOS), automated terminal information service (ATIS), meteorological terminal aviation routine weather reports (METAR), terminal aerodrome forecast (TAF), or WINDS ALOFT may be used as data sources.

Inputs for a disclosed computer program, whether entered by a flight management system or by the pilot, may include, but are not limited to, latitude of a NAVAID, longitude of the NAVAID, altitude of the NAVAID, the FAA number designation for the type of aircraft, the altitude of the aircraft during holding, the NAVAID to holding fix distance and bearing, the direction of the outbound turn (right or left), the wind speed and bearing, the hold bearing, and the bank angle during turns. Micro air data computers (MADCs) may provide to the FMS barometric altitude, pressure altitude, indicated airspeed, true airspeed, Mach number, vertical airspeed, maximum operating airspeed, static and total air temperature. (The true airspeed computation may be derived from calibrated airspeed, temperature, and pressure altitude). The magnetic sensor unit (MSU) detects the horizontal component of the earth's magnetic field and transmits it to an altitude and heading reference unit (AHRU) for use as a heading reference. In MSU calibration mode, the AHRU determines the MSU calibration coefficients used for compensation of single and dual cycle MSU errors. The MSU calibration algorithm is able to compensate single and dual cycle errors in sum up to 12 degrees. The AHRU is a strap down inertial measurement system using fiber optic rate gyros and micromechanical accelerometers that are "strapped down" to the principle aircraft axes. A digital computer mathematically integrates the rate data to obtain heading, pitch, and roll.

The FAA specifies a one-minute inbound leg for altitudes less than or equal to 14,000 feet (ft). Above 14,000 feet, the inbound leg is 1.5 minutes. The time elapsed during the outbound leg is calculated from the ground speed and the distance between the starting point of the leg and its end.

In an embodiment, the following steps (a)-(m) may be used to calculate a left or right hand aeronautical holding pattern:

(a) determining wind speed and direction;

(b) choosing a direction of a holding pattern from the group comprising left-hand and right-hand;

(c) selecting a start point and an end point of an inbound leg of the holding pattern;

(d) generating, e.g., with an electronic processor, a curved path trajectory of an aircraft given the wind speed and direction determined in step (a) making a turn in the direction chosen in step (b);

(e) copying and translating the curved path trajectory, with the electronic processor, so that for a first copy its starting point is the end point of the inbound leg selected in step (c), and for a second copy its ending point is the start point of the inbound leg selected in step (c);

(f) running a search routine, with the electronic processor, to locate positions on the first and second copy of the curved path trajectory that are tangent to the curved path trajectory; and (g) making the positions located in step (f) the start and end points of an outbound leg of the holding pattern;

(h) notifying a pilot, using the electronic processor, of a maximum allowed holding pattern airspeed for an aircraft;

(i) inputting a bank angle selected by the pilot into the electronic processor;

(j) generating and displaying, using the electronic processor, holding patterns for the maximum allowed airspeed and optionally at least two lesser airspeeds;

(k) displaying boundaries of a protected airspace within which the aircraft must fly with the holding patterns of step (j), enabling the pilot to see if the holding patterns are within the protected airspace;

(l) if none of the holding patterns of step (j) are within the protected airspace, enabling the pilot to input a greater bank angle into the electronic processor, and generating and displaying new holding patterns using the electronic processor; and (m) using global positioning data to display the position of the aircraft in the display of the holding patterns and boundaries of the protected airspace.

If there is no wind, the spiral path becomes circular. These steps may be implemented by a computer or other electronic processor, which may be a stand-alone device or be integrated into the system of an aircraft. Without generating projections from both the first and second copy of the spiral path simultaneously, one may identify incorrect points.

If the spiral path generated in step (d) is generated by solving differential equations, it may be constructed from solutions of the following differential equations, where the fix is the ending point of the inbound leg, and is set at the origin (0, 0), and the x- and y-positions (with x being the east-west dimension and y being the north-south dimension, with east and north being the positive directions) of the aircraft at time t (in seconds) are:

$$x=as*[\sin(abo+dps*t)]/dps+ws*[\cos(wb)]*t, \text{ and}$$

$$y=-as*[\cos(abo+dps*t)]/dps+ws*[\sin(wb)]*t,$$

wherein:

* represents multiplication;

dps=rate of change in the bearing in radians per second;

as=airspeed in meters per second;

t=time;

ws=wind speed in meters per second;

wb=standard position angle representation of the wind bearing in radians; and abo=inbound bearing in radians represented as an angle in standard position.

A mathematically equivalent form of the two equations above can be written as:

$$x = \frac{as\sin(abo + dpst)}{dps} + ws\cos(wb)t, \text{ and}$$

$$y = -\frac{as\cos(abo + dpst)}{dps} + ws\sin(wb)t.$$

An advantage of the present disclosure relates to variable bank and airspeed. Bank is usually constant and maintained with the flight director and autopilot. Allowing the pilot to alter the bank and then choose an airspeed appropriate for the hold is a unique feature, especially when combined with the visual presentation. Incoming GPS data may be stored in a file that is repetitively read into the computer program, which then displays the position of the aircraft on the same graph as the holding pattern.

In an embodiment, an FMS (or any other suitable system) aboard an aircraft may receive holding instructions for the aircraft (e.g. from a flight crew member or an external transmitter via a receiver on the aircraft). The holding instructions may be received in any suitable form, and may comprise various pieces of information to calculate a holding pattern. For example, the holding instructions may comprise a holding fix, a holding direction (e.g., right turn or left turn), an inbound leg course, and an altitude. The FMS may also obtain an airspeed for the aircraft, a wind speed, and a wind direction affecting the aircraft. The FMS may then calculate a holding pattern for the aircraft using the holding instructions, the wind speed, the wind direction, a duration of the inbound leg course (which may be determined based on the holding altitude), and the airspeed. Further, the FMS may obtain FAA protected airspace limits associated with the holding fix, and then present the holding pattern and/or the FAA protected airspace limits to a flight crew member on the aircraft. In an embodiment, presentation of the holding pattern and/or the FAA protected airspace limits takes place prior to the aircraft arriving at the holding fix. Alternatively, instructions may be provided to an autopilot or flight director to fly the aircraft in the holding pattern.

In an embodiment, the FMS may further receive one or more updated parameters that affect the holding pattern. The updated parameters may comprise a change in the airspeed, a change in the holding instructions, a change in wind speed, a change in wind direction, or other relevant parameters, or combinations thereof. The FMS may recalculate the holding pattern for the aircraft using the updated parameter and then present the recalculated holding pattern to the flight crew member.

The following are example embodiments of using the present disclosure to calculate right hand (clockwise) holding patterns. Prompts and output may be displayed by a computer system, and data inputs may be made by a user. Everything is displayed, except what is enclosed in parentheses, but including what is enclosed in brackets and single digits enclosed in parentheses.

In an embodiment, a user may first provide various input information. Specifically, the user first may access a file, e.g., by using command >read 'holdpattern12.m':holdpattern12[Hold]( ). Then, the user may input the following information (Note that the user may type a semicolon and then press the Enter key after each input):

- a NAVAID latitude, e.g., as [N or S, degrees, minutes, seconds]. An exemplary value may be [N, 31, 38, 16];
- a NAVAID longitude, e.g., as [E or W, degrees, minutes, seconds]. An exemplary value may be [W, 97, 4, 45];
- a NAVAID elevation (in feet or any other suitable unit). An exemplary value may be 516 feet;
- a maximum holding speed of aircraft (in Knots-Indicated Airspeed (KIAS) or any other suitable unit). An exemplary value may be 210 KIAS, i.e., maximum airspeed=210 KIAS;
- an altitude (in feet or any other suitable unit). An exemplary value may be 6000 feet;
- a NAVAID to FIX distance in nautical miles (NM). An exemplary value may be 12 NM;

a NAVAID to FIX bearing in degrees. An exemplary value may be 300 degrees;

a holding bearing in degrees. An exemplary value may be 45 degrees;

a turning direction, e.g., input 1 for Right Turn, 2 for Left Turn, 3 for figure eight right, 4 for figure eight left. An exemplary turning direction may be 1 (Alternatively, a holding direction may be used, e.g. northeast of the holding fix);

a wind speed in knots. An exemplary value may be 40 knots;

a direction in which wind is blowing from (in degrees or any other suitable unit). An exemplary value may be 305 degrees; and a bank angle (in degrees or any other suitable unit). An exemplary value may be 20 degrees.

In another embodiment, the user may provide different input information. For example, the user may input the following information (Note that the user may type a semicolon and then press the Enter key after each input):

Input NAVAID latitude in brackets, as [N or S, degrees, minutes, seconds], e.g., [N, 31, 38, 16];

Input NAVAID longitude in brackets, as [E or W, degrees, minutes, seconds], e.g., [W, 97, 4, 45];

Input NAVAID elevation in feet, e.g., 516;

Civil Aircraft (classified by a maximum holding altitude (MHA))

(1) MHA through 6,000 ft.

(2) Above 6,000 ft through 14,000 ft (3) Above 14,000 ft

Military Aircraft (4) All except aircraft listed below (5) T-38, F-15, and F-16

(6) USAF F-4 Aircraft (7) B-1, F-111, and F-5

(8) T-37

Input the integer of aircraft type, e.g., 3; (note that aircraft type for civil aircraft is used loosely herein to refer to altitude range.)

Maximum airspeed=265 KIAS

Input altitude in feet (No commas), e.g., 15000;

Input NAVAID to FIX distance in NM, e.g., 12;

Input NAVAID to FIX bearing in degrees, e.g., 325;

Input holding bearing in degrees, e.g., 45;

Input 1 for right turn, 2 for left turn, 3 for figure eight type, e.g., 1;

Input wind speed in knots, e.g., 30;

Input direction wind is blowing from in degrees, e.g., 125;

Input bank angle in degrees, e.g., 20;

In an embodiment, exemplary values can be set as:

Latitude of FIX=N 31 degrees, 48.08 minutes.

Longitude of FIX=W 97 degrees, 12.84 minutes.

FIX to NAVAID slant DME=12.23 NM

Holding bearing=045 degrees.

Inbound bearing=225 degrees.

Altitude=15000 feet.

Wind blowing from=125 degrees.

Wind blowing toward=305 degrees.

Wind speed=30 knots.

Figure 4:
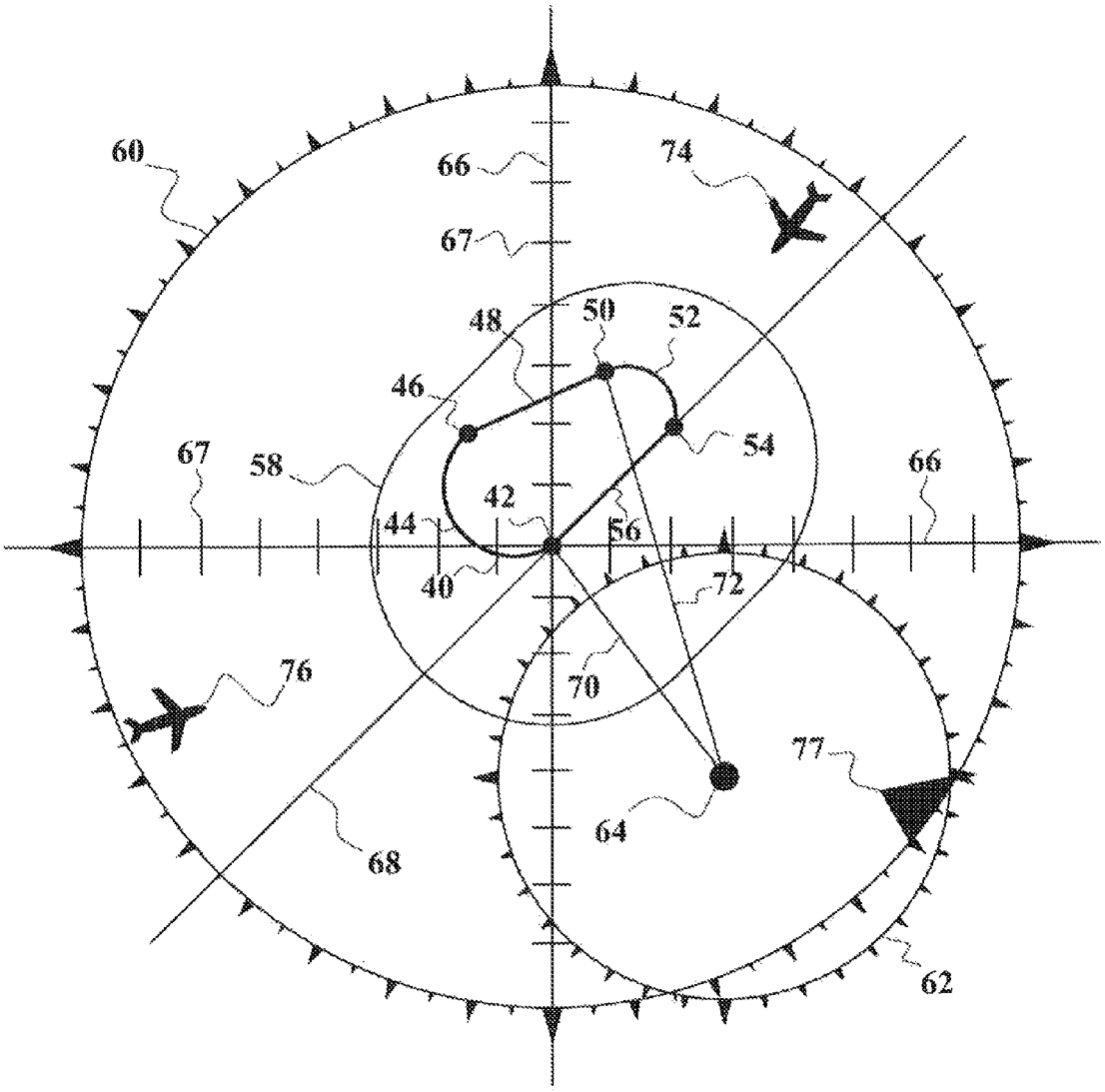
FIG. 4 is a graphical representation of a first right hand holding pattern generated using an embodiment disclosed herein.

Pattern 1 (40 shown in FIG. 4):

Indicated inbound airspeed=186 knots.

Altitude-corrected inbound airspeed=241 knots.

Inbound ground speed=245 knots.

Wind corrected inbound bearing=218 degrees.

Turn RIGHT (at FIX 42) with bank angle=20 degrees [1.65 degrees/second] (the outbound turn 44) to outbound wind corrected bearing of 67 degrees (at post 46, the start of outbound leg 48).

Fly on that outbound heading for 105 seconds until the bearing back to NAVAID is 165 degrees (at post 50, the end of the outbound leg).

Turn RIGHT with bank angle=20 degrees [1.65 degrees/second] (the inbound turn 52) back to the start (at post 54) of inbound leg (56). (The end of the inbound leg is 42, the FIX where the holding pattern started and may be repeated.)

Latitude at end of outbound leg=N 31 degrees, 55.54 minutes.

Longitude at end of outbound leg=W 97 degrees, 10.24 minutes.

DME to NAVAID at end of outbound leg=18.07 NM.

Area enclosed in oval 58 is a subset of FAA Basic Template 15, indicating the area within which the holding pattern is supposed to be contained.

Inbound leg=6.13 NM, Template 15 LM=9.60 NM, LI=7.70 NM.

Directions are indicated by the larger circle 60 with compass points surrounding the FIX and the smaller circle 62 with compass points surrounding the NAVAID 64. Cross lines 66 and nautical mile markers 67 indicate distance from the FIX. Line 68 indicates the direction of the inbound leg, which is toward the lower left. Line 70 indicates the distance and direction from the FIX to the NAVAID. Line 72 indicates the direction of the point 50 at which the outbound leg ends and the inbound turn begins to the NAVAID. Icon 74 indicates the wind corrected inbound heading. Icon 76 indicates the outbound wind corrected heading. Triangle 77 indicates the wind direction. The oval 58 may be formed by two semicircles connected by straight line segments. One of the semicircles is centered on the FIX. LM is the distance between the fix and the center of the other semicircle. LI is the radius of both semicircles.

Figure 5:
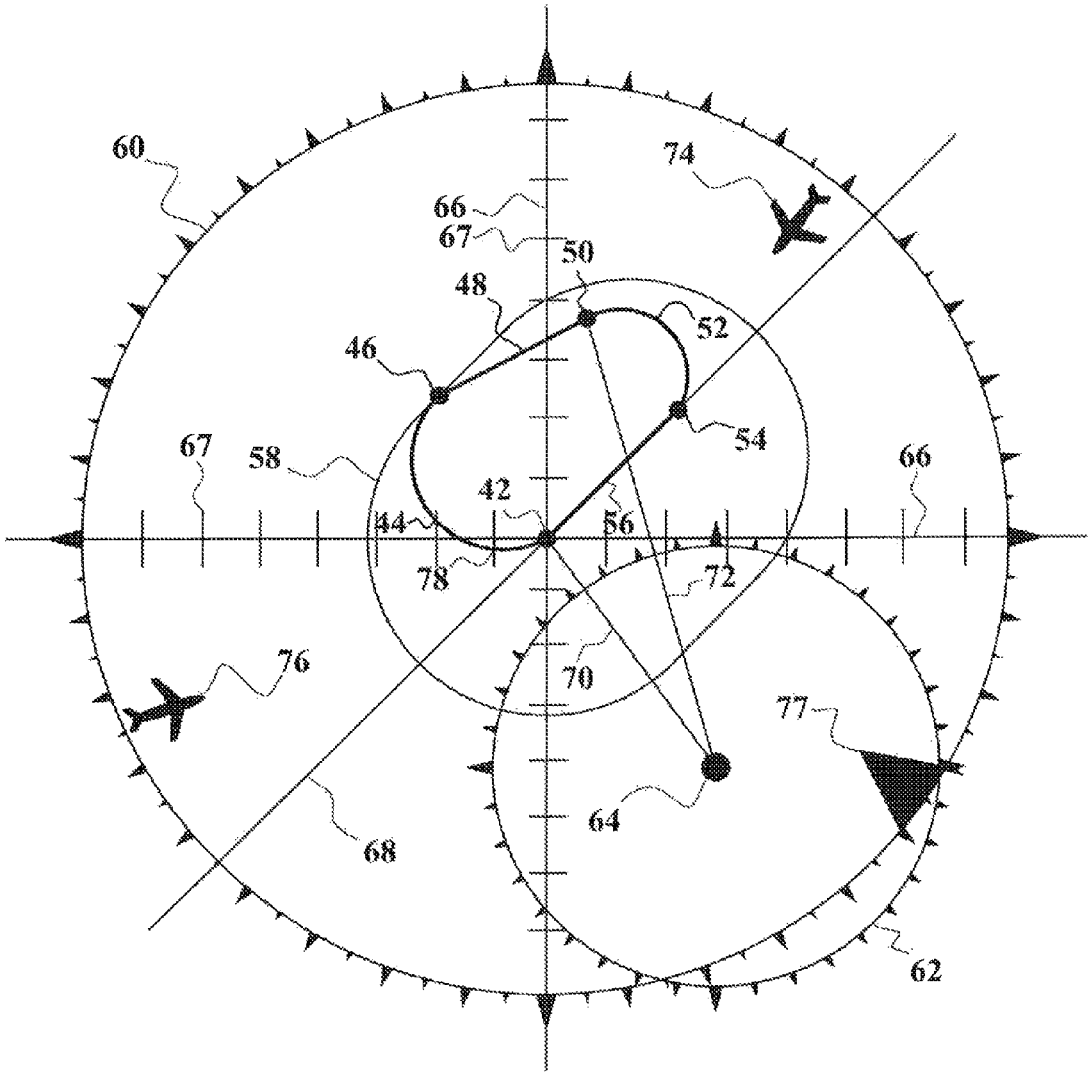
FIG. 5 is a graphical representation of a second right hand holding pattern generated using an embodiment disclosed herein.

Pattern 2 (78 shown in FIG. 5):

Indicated inbound airspeed=225 knots.

Altitude-corrected inbound airspeed=293 knots.

Inbound ground speed=297 knots.

Wind corrected inbound bearing=219 degrees.

Turn RIGHT (at FIX 42) with bank angle=20 degrees [1.36 degrees/second] (the outbound turn 44) to outbound wind corrected bearing of 67 degrees (at post 46, the start of outbound leg 48).

Fly on that outbound heading for 104 seconds until the bearing back to NAVAID is 166 degrees (at post 50, the end of the outbound leg).

Turn RIGHT with bank angle=20 degrees [1.36 degrees/second] (the inbound turn 52) back to start (at post 54) of inbound leg (56). (The end of the inbound leg is 42, the FIX where the holding pattern started and may be repeated.)

Latitude at end of outbound leg=N 31 degrees, 58.09 minutes.

Longitude at end of outbound leg=W 97 degrees, 10.51 minutes.

DME to NAVAID at end of outbound leg=20.58 NM.

Area enclosed in oval 58 is a subset of FAA Basic Template 15.

Inbound leg=7.42 NM, Template 15 LM=9.60 NM, LI=7.70 NM.

Figure 6:
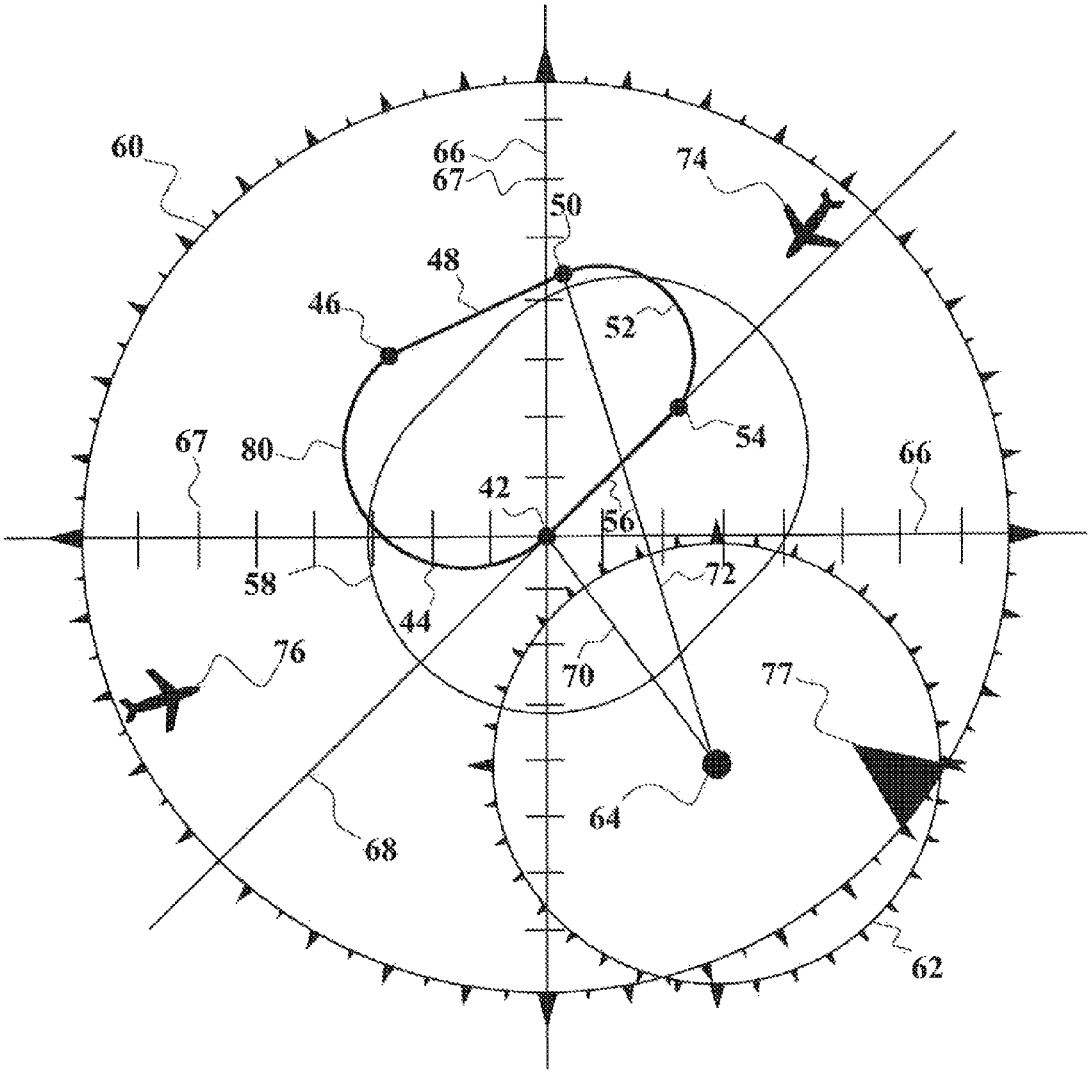
FIG. 6 is a graphical representation of a third right hand holding pattern generated using an embodiment disclosed herein.

Pattern 3 (80 shown in FIG. 6):

Indicated inbound airspeed=265 knots.

Altitude-corrected inbound airspeed=344 knots.

Inbound ground speed=348 knots.

Wind corrected inbound bearing=220 degrees.

Turn RIGHT (at FIX 42) with bank angle=20 degrees [1.15 degrees/second] (the outbound turn 44) to outbound wind corrected bearing of 65 degrees (at post 46, the start of outbound leg 48).

Fly on that outbound heading for 103 seconds until the bearing back to NAVAID is 167 degrees (at post 50, the end of the outbound leg).

Turn RIGHT with bank angle=20 degrees [1.15 degrees/second] (the inbound turn 52) back to start (at post 54) of inbound leg (56). (The end of the inbound leg is 42, the FIX where the holding pattern started and may be repeated.)

Latitude at end of outbound leg=N 32 degrees, 0.96 minutes.

Longitude at end of outbound leg=W 97 degrees, 11.13 minutes.

DME to NAVAID at end of outbound leg=23.48 NM.

Area enclosed in oval 58 is a subset of FAA Basic Template 15. (Note that this holding pattern passes outside where FAA regulations say that it should be.)

Inbound leg=8.70 NM, Template 15 LM=9.60 NM, LI=7.70 NM.

The following are example embodiments of using the present disclosure to calculate left hand (counterclockwise) holding patterns. Prompts and output may be displayed by a computer system, and data inputs may be made by a user. After each input, type a semicolon and then press Enter.

Input NAVAID latitude in brackets, [N or S, degrees, minutes, seconds], e.g., [N, 31, 38, 16];

Input NAVAID longitude in brackets, [E or W, degrees, minutes, seconds], e.g., [W, 97, 4, 45];

Input NAVAID elevation in feet, e.g., 516;

Civil Aircraft (1) MHA through 6,000 ft.

(2) Above 6,000 ft through 14,000 ft (3) Above 14,000 ft

Military Aircraft (4) All except aircraft listed below (5) T-38, F-15, and F-16

(6) USAF F-4 Aircraft (7) B-1, F-111, and F-5

(8) T-37

Input the integer of aircraft type, e.g., 3;

Maximum airspeed=265 KIAS

Input altitude in feet (No commas), e.g., 15000;

Input NAVAID to FIX distance in NM, e.g., 12;

Input NAVAID to FIX bearing in degrees, e.g., 325;

Input holding bearing in degrees, e.g., 45;

Input 1 for right turn, 2 for left turn, 3 for figure eight type, e.g., 2;

Input wind speed in knots, e.g., 35;

Input direction wind is blowing from in degrees, e.g., 125;

Input bank angle in degrees, e.g., 25;

Latitude of FIX=N 31 degrees, 48.08 minutes.

Longitude of FIX=W 97 degrees, 12.84 minutes.

FIX to NAVAID slant DME=12.23 NM

Holding bearing=045 degrees.

Inbound bearing=225 degrees.

Altitude=15000 feet.

Wind blowing from=125 degrees.

Wind blowing toward=305 degrees.

Wind speed=35 knots.

Figure 7:
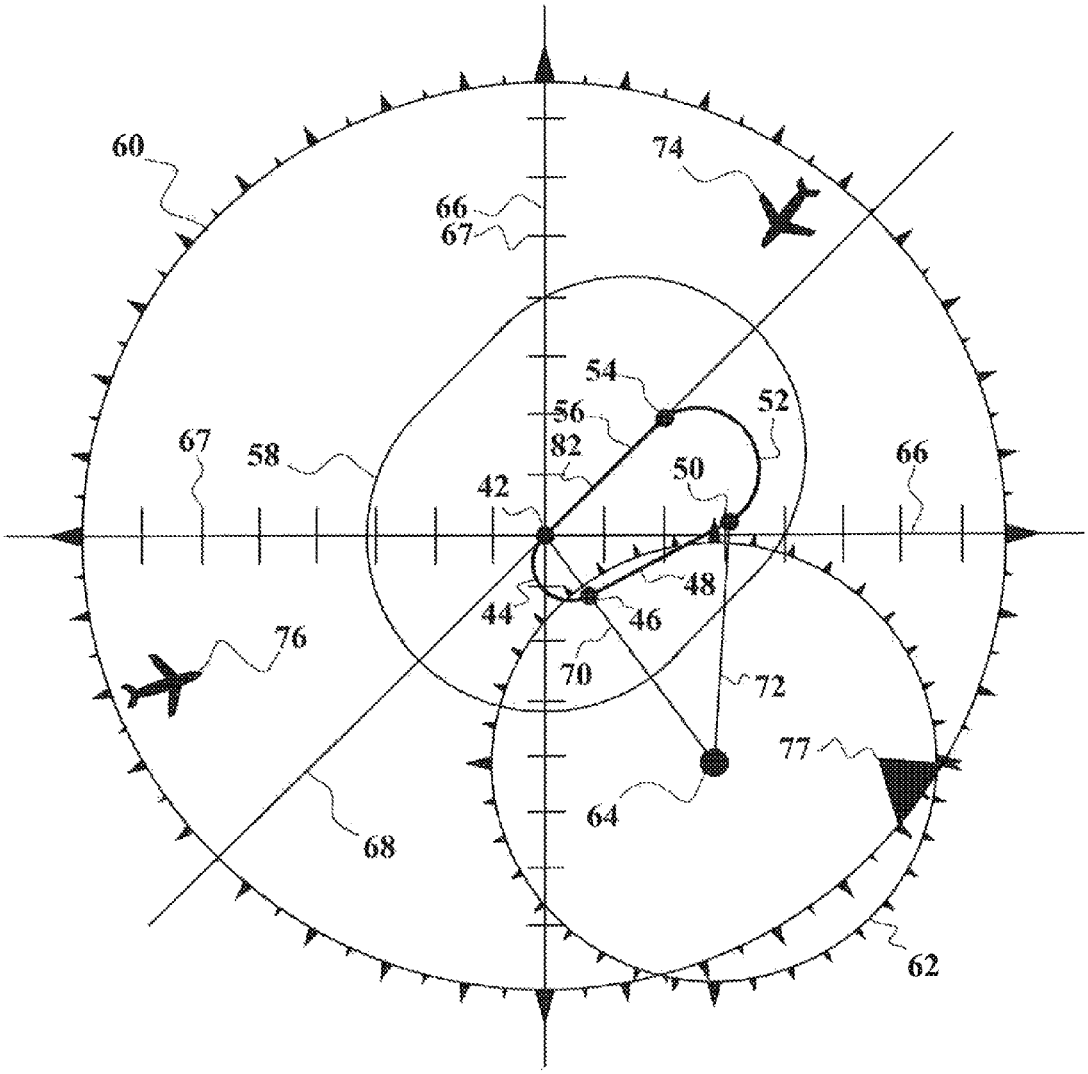
FIG. 7 is a graphical representation of a first left hand holding pattern generated using an embodiment disclosed herein.

Pattern 1 (82 shown in FIG. 7):

Indicated inbound airspeed=186 knots.

Altitude-corrected inbound airspeed=241 knots.

Inbound ground speed=245 knots.

Wind corrected inbound bearing=217 degrees.

Turn LEFT (at FIX 42) with bank angle=25 degrees [2.11 degrees/second] (the outbound turn 44) to outbound wind corrected bearing of 69 degrees (at post 46, the start of outbound leg 48).

Fly on that outbound heading for 106 seconds until the bearing back to NAVAID is 182 degrees (at post 50, the end of the outbound leg).

Turn LEFT with bank angle=25 degrees [2.11 degrees/second] (the inbound turn 52) back to start (at post 54) of inbound leg (56). (The end of the inbound leg is 42, the FIX where the holding pattern started and may be repeated.)

Latitude at end of outbound leg=N 31 degrees, 49.07 minutes.

Longitude at end of outbound leg=W 97 degrees, 4.31 minutes.

DME to NAVAID at end of outbound leg=11.09 NM.

Area enclosed in oval 58 is a subset of FAA Basic Template 15.

Inbound leg=6.13 NM, Template 15 LM=9.60 NM, LI=7.70 NM.

Figure 8:
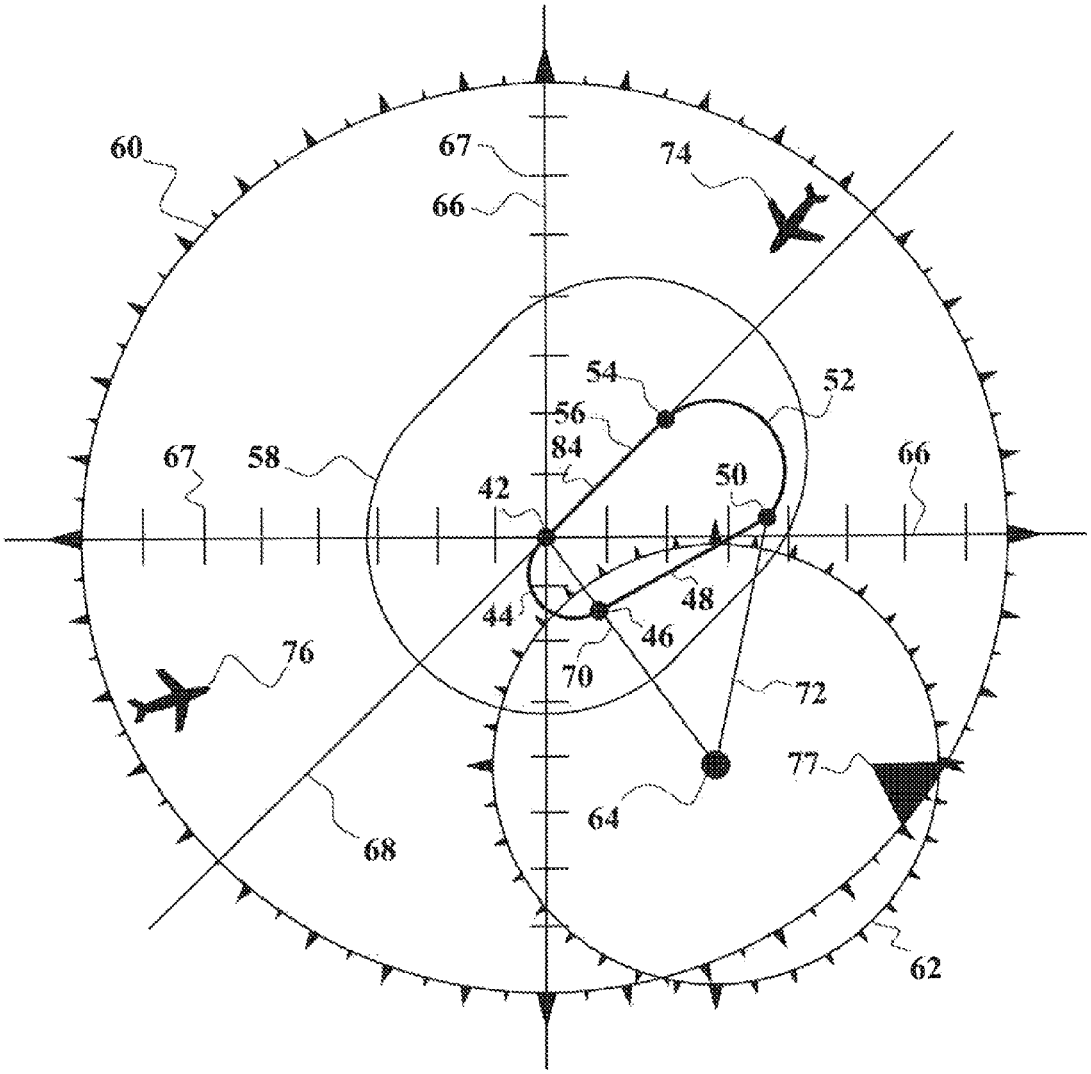
FIG. 8 is a graphical representation of a second left hand holding pattern generated using an embodiment disclosed herein.

Pattern 2 (84 shown in FIG. 8):

Indicated inbound airspeed=225 knots.

Altitude-corrected inbound airspeed=293 knots.

Inbound ground speed=297 knots.

Wind corrected inbound bearing=218 degrees.

Turn LEFT (at FIX 42) with bank angle=25 degrees [1.74 degrees/second] (the outbound turn 44) to outbound wind corrected bearing of 67 degrees (at post 46, the start of outbound leg 48).

Fly on that outbound heading for 105 seconds until the bearing back to NAVAID is 194 degrees (at post 50, the end of the outbound leg).

Turn LEFT with bank angle=25 degrees [1.74 degrees/second] (the inbound turn 52) back to start (at post 54) of inbound leg (56).

Latitude at end of outbound leg=N 31 degrees, 48.58 minutes.

Longitude at end of outbound leg=W 97 degrees, 1.73 minutes.

DME to NAVAID at end of outbound leg=10.92 NM.

Area enclosed in oval 58 is a subset of FAA Basic Template 15.

Inbound leg=7.42 NM, Template 15 LM=9.60 NM, LI=7.70 NM.

Figure 9:
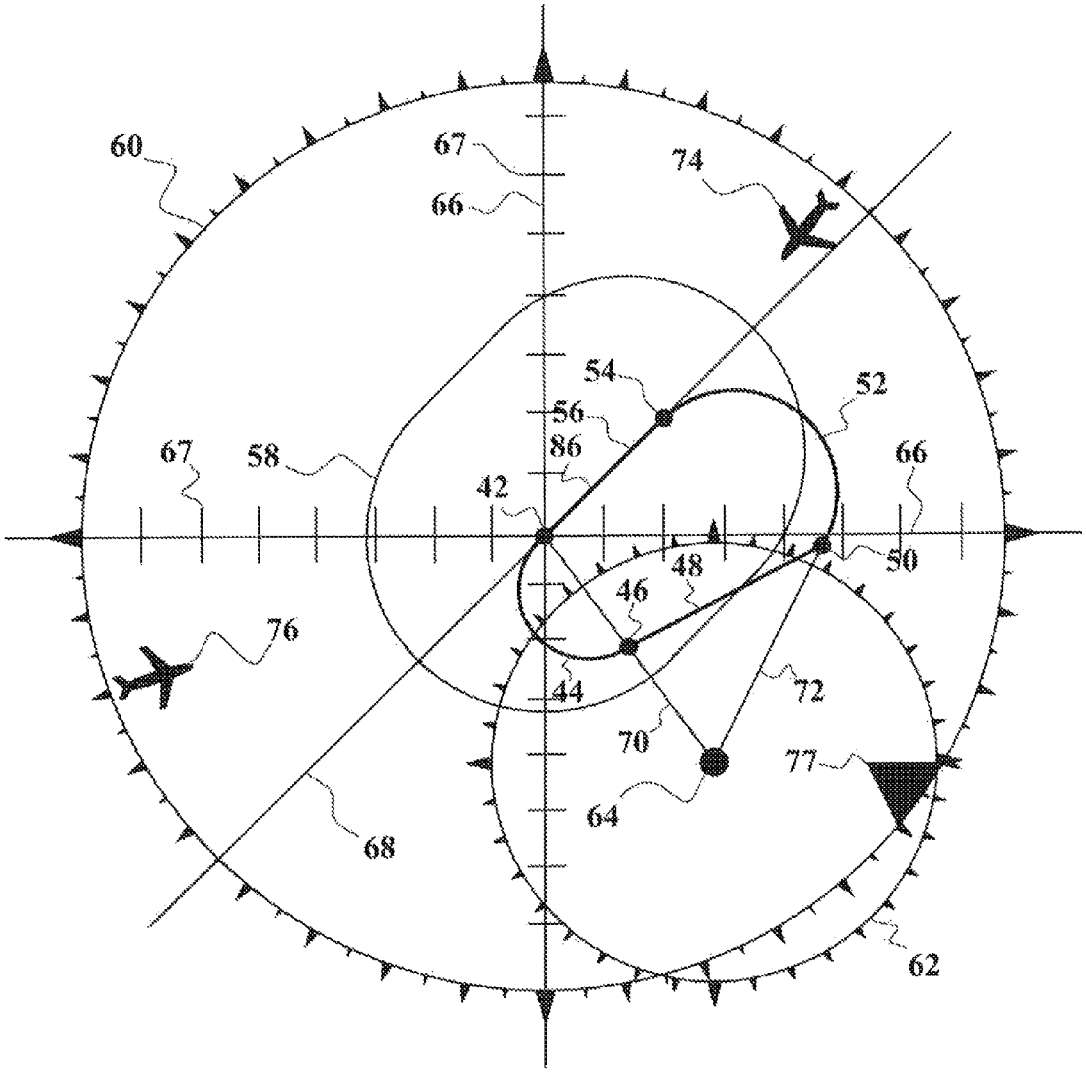
FIG. 9 is a graphical representation of a third left hand holding pattern generated using an embodiment disclosed herein.

Pattern 3 (86 shown in FIG. 9):

Indicated inbound airspeed=265 knots.

Altitude-corrected inbound airspeed=344 knots.

Inbound ground speed=349 knots.

Wind corrected inbound bearing=219 degrees.

Turn LEFT with bank angle=25 degrees [1.48 degrees/second] (the outbound turn 44) to outbound wind corrected bearing of 65 degrees (at post 46, the start of outbound leg 48).

Fly on that outbound heading for 104 seconds until the bearing back to NAVAID is 207 degrees (at post 50, the end of the outbound leg).

Turn LEFT with bank angle=25 degrees [1.48 degrees/second] (the inbound turn 52) back to start (at post 54) of inbound leg (56).

Latitude at end of outbound leg=N 31 degrees, 47.84 minutes.

Longitude at end of outbound leg=W 96 degrees, 58.93 minutes.

DME to NAVAID at end of outbound leg=11.06 NM.

Area enclosed in oval 58 is a subset of FAA Basic Template 15. (Note that this holding pattern passes outside where FAA regulations say that it should be.)

Inbound leg=8.73 NM, Template 15 LM=9.60 NM, LI=7.70 NM.

Figure eight holding patterns are a unique alternative to regular holding patterns that may be used when the winds are very high and are perpendicular to the inbound holding course. The figure eight patterns have two turns into the wind direction, which minimizes the chance of being blown outside of the protected holding airspace. Optimum conditions for these patterns are high velocity winds (e.g. winds higher than 25% of the airspeed) perpendicular to the inbound course, or not more than +30 degrees or −30 degrees from perpendicular in relation to the inbound course. For example, if the inbound course is on the 360 degree radial, heading 180 degrees (south), and the wind is from 90 degrees (east) at 80 knots or greater and the airspeed is 320 knots or less. A figure eight pattern would work just as well for that inbound course, heading and wind speed, with wind having a bearing up to 30 degrees less than 90 degrees (e.g., 80, 70 or 60 degrees) or up to 30 degrees more (e.g., 100, 110 or 120 degrees). Except in this type of scenario, a regular holding pattern should be used.

Computer-generated simulated figure eight flight paths indicate holding patterns may occupy less air space as the acute angle between wind direction and the hold bearing increases. Figure eight holding patterns cannot be successfully completed when moderate winds flow close to parallel to the hold bearing. Patterns were generated for the condition where the aircraft turns into wind at both ends of the inbound leg. Patterns differ slightly when the aircraft has a headwind rather than a tailwind on entering the inbound leg. Figure eight holding patterns can be very compact under high wind conditions, provided that the wind direction is nearly perpendicular to the hold bearing. In light winds, Figure eight patterns can be successfully completed when the wind direction is not close to perpendicular to the inbound leg. Figure eight holding patterns are more compact than elliptical holding patterns to remain within the airspace required by FAA Order 7130.3A, including all modifying FAA Memoranda, or its successor regulations.

In an embodiment, the following steps (a)-(p) may be used to calculate a figure eight aeronautical holding pattern:

(a) determining wind speed and direction;

(b) selecting a start point and an end point of an inbound leg of the holding pattern;

(c) generating, with an electronic processor and by solving differential equations (or by repeated triangulation), a first spiral path of an aircraft given the wind speed and direction determined in step (a) and making a turn into the wind;

(d) copying and translating the first spiral path, with the electronic processor, so that for a first copy its starting point is the end point of the inbound leg selected in step (b), and for a second copy its ending point is the end point of the inbound leg selected in step (b);

(e) generating, with an electronic processor and by solving differential equations (or by repeated triangulation), a second spiral path of an aircraft given the wind speed and direction determined in step (a) and making a turn in the opposite direction from the turn in step (c);

(f) copying and translating the second spiral path, with the electronic processor, so that for a third copy its starting point is the start point of the inbound leg selected in step (b), and for a fourth copy its ending point is the start point of the inbound leg selected in step (b);

(g) running a search routine, with the electronic processor, to locate positions on the first and fourth copies that have, as close as possible, the same bearing;

(h) making the positions located in step (g) the start and end points of a first straight line portion of the figure eight holding pattern;

(i) running a search routine, with the electronic processor, to locate positions on the second and third copies that have, as close as possible, the same bearing;

(j) making the positions located in step (i) the start and end points of a second straight line portion of the figure eight holding pattern;

(k) notifying a pilot, using the electronic processor, of a maximum allowed holding pattern airspeed for an aircraft;

(l) inputting a bank angle selected by the pilot into the electronic processor;

(m) generating and displaying, using the electronic processor, holding patterns for the maximum allowed airspeed and at least two lesser airspeeds;

(n) displaying boundaries of a protected airspace within which the aircraft must fly with the holding patterns of step (m), enabling the pilot to see if the holding patterns are within the protected airspace;

(o) if none of the holding patterns of step (m) are within the protected airspace, enabling the pilot to input a greater bank angle into the electronic processor, and generating and displaying new holding patterns using the electronic processor; and (p) using global positioning data to display the position of the aircraft in the display of the holding patterns and boundaries of the protected airspace.

Again, if there is no wind, the spiral path becomes circular. These steps may be implemented by a computer or other electronic processor, which may be a stand-alone device, or integrated into the system of an aircraft. Without generating projections from the copies of the spiral paths simultaneously, one may frequently identify incorrect points.

If the first and second spiral paths are generated by solving differential equations, they be constructed from solutions of the following differential equations, where the fix is the ending point of the inbound leg, and is set at the origin (0, 0), and the x- and y-positions of the aircraft at time t (in seconds) are:

$$x=as*[\sin(abo+dps*t)]/dps+ws*[\cos(wb)]*t, \text{ and}$$

$$y=-as*[\cos(abo+dps*t)]/dps+ws*[\sin(wb)]*t,$$

wherein:

dps=rate of change in the bearing in radians per second;

as=airspeed in meters per second;

t=time;

ws=wind speed in meters per second;

wb=standard position angle representation of the wind bearing in radians; and abo=inbound bearing in radians represented as an angle in standard position.

The following are example embodiments of using the present disclosure to calculate figure eight holding patterns. Prompts and output may be displayed by a computer system, and data inputs may be made by a user. Everything is displayed, except what is enclosed in parentheses, but including what is enclosed in brackets and single digits enclosed in parentheses. The following are common to all six patterns, except as indicated:

After each input, type a semicolon and then press Enter.

Input NAVAID latitude, in brackets [N or S, degrees, minutes, seconds], e.g., [N, 31, 38, 16];

Input NAVAID longitude, in brackets [E or W, degrees, minutes, seconds], e.g., [W, 97, 4, 45];

Input NAVAID elevation in feet, e.g., 516;

Civil Aircraft (as classified by MHA)

(1) MHA through 6,000 ft.

(2) Above 6,000 ft through 14,000 ft (3) Above 14,000 ft

Military Aircraft (4) All except aircraft listed below (5) T-38, F-15, and F-16

(6) USAF F-4 Aircraft
(7) B-1, F-111, and F-5
(8) T-37

Input the integer of aircraft type, e.g., 3;
Maximum airspeed=265 KIAS
Input altitude in feet (No commas), e.g., 15000;
Input NAVAID to FIX distance in NM, e.g., 12;
Input NAVAID to FIX bearing in degrees, e.g., 300;
Input holding bearing in degrees. 45;
Input 1 for right turn, 2 for left turn, 3 for FIG. 8 right, 4 for figure eight left, e.g., 3;
Input wind speed in knots, e.g., 65;
Input direction wind is blowing from in degrees, e.g., 325; (Indicated by triangle 91.)
Input bank angle in degrees, e.g., 20;
Latitude of FIX=N 31 degrees, 44.25 minutes.
Longitude of FIX=W 97 degrees, 16.96 minutes.
FIX to NAVAID slant DME=12.23 NM
Xproduct=0.98
Holding bearing=045 degrees.
Inbound bearing=225 degrees.
Altitude=15,000 feet.
Wind blowing from=325 degrees.
Wind blowing toward=145 degrees.
Wind speed=65 knots.

Figure 10:
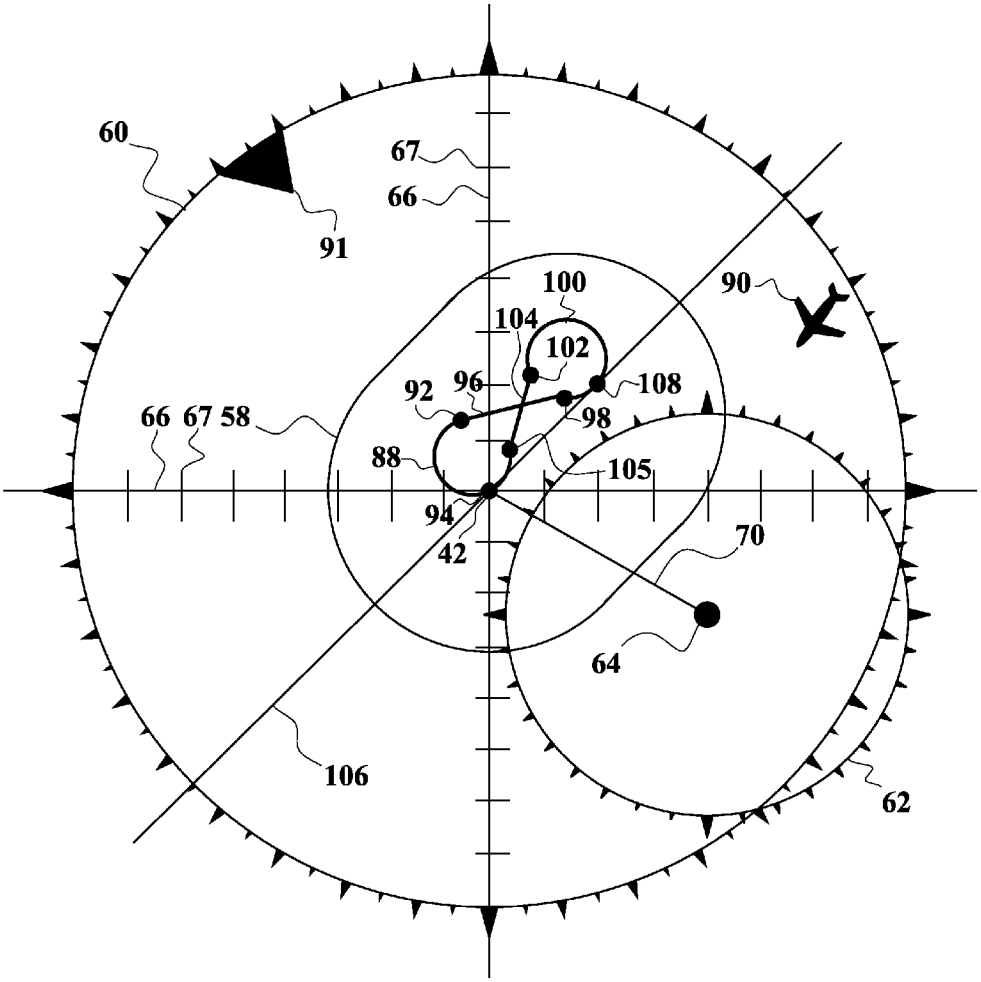
FIG. 10 is a graphical representation of a first figure eight holding pattern generated using an embodiment disclosed herein.

Pattern 1 (88 shown in FIG. 10—initial right turn when wind is from the right):
Indicated inbound airspeed=186 knots.
Altitude-corrected inbound airspeed=241 knots.
Inbound ground speed=244 knots.
Wind corrected inbound bearing=240 degrees
(as indicated by icon 90.)
Enter the holding pattern at FIX 42, and turn RIGHT until bearing is 60.0 degrees (at post 92, the end of the outbound turn 94 and the beginning of the outbound leg 96).
Level and fly that bearing until the bearing back to NAVAID is 144.8 degrees (at post 98, the end of the outbound leg and the beginning of the inbound turn 100).
(At post 98) Turn LEFT (passing through tangent point 108) until bearing is 200.0 degrees (at post 102, the beginning of the inbound leg 104).
Level and fly that bearing until the bearing back to NAVAID is 127.5 degrees (at post 105, the end of the inbound leg and the beginning of the outbound turn 94).
Begin RIGHT turn (on outbound turn 94) and repeat circuit. (Note that the outbound turn begins before the FIX.)
Start of inbound leg to NAVAID slant DME=12.21 NM.
Latitude of start of inbound leg=N 31 degrees, 48.57 minutes.
Longitude of start of inbound leg=W 97 degrees, 11.90 minutes.
Area enclosed in oval 58 is a subset of FAA Basic Template 15.
Inbound leg=6.10 NM, Template 15 LM=9.60 NM, LI=7.70 NM.
Line 106 indicates the inbound bearing, and passes through the FIX 42 and a tangent point 108 on the inbound turn 100.

Figure 11:
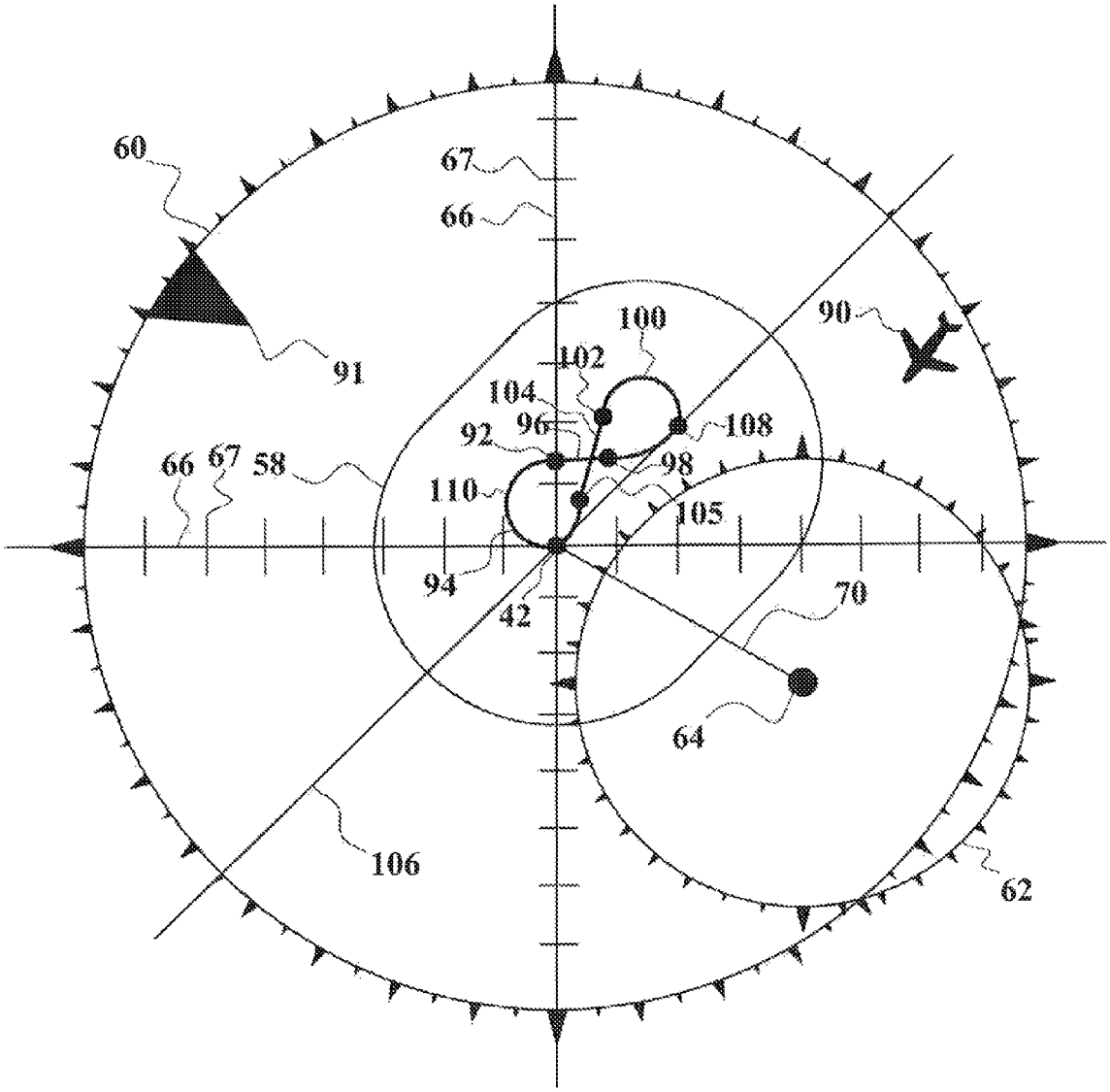
FIG. 11 is a graphical representation of a second figure eight holding pattern generated using an embodiment disclosed herein.

Pattern 2 (110 shown in FIG. 11—initial right turn when wind is from the right):
Input direction wind is blowing from in degrees, e.g., 305; (Indicated by triangle 91.)
Wind blowing from=305 degrees.
Wind blowing toward=125 degrees.
Wind speed=65 knots.
Indicated inbound airspeed=186 knots.
Altitude-corrected inbound airspeed=241 knots.
Inbound ground speed=221 knots.
Wind corrected inbound bearing=240 degrees.
Enter the holding pattern at FIX 42, and turn RIGHT until bearing is 78.0 degrees (at post 92, the end of the outbound turn 94 and the beginning of the outbound leg 96).
Level and fly that bearing until the bearing back to NAVAID is 137.8 degrees (at post 98, the end of the outbound leg and the beginning of the inbound turn 100).
(At post 98) Turn LEFT, passing through tangent point 108, until bearing is 205.0 degrees (at post 102, the beginning of the inbound leg 104).
Level and fly that bearing until the bearing back to NAVAID is 126.0 degrees (at post 105, the end of the inbound leg and the beginning of the outbound turn 94).
Begin RIGHT turn (on outbound turn 94) and repeat circuit.
Start of inbound leg to NAVAID slant DME=12.08 NM.
Latitude of start of inbound leg=N 31 degrees, 48.16 minutes.
Longitude of start of inbound leg=W 97 degrees, 12.37 minutes.
Area enclosed in oval 58 is a subset of FAA Basic Template 15.
Inbound leg=5.52 NM, Template 15 LM=9.60 NM, LI=7.70 NM.

Figure 12:
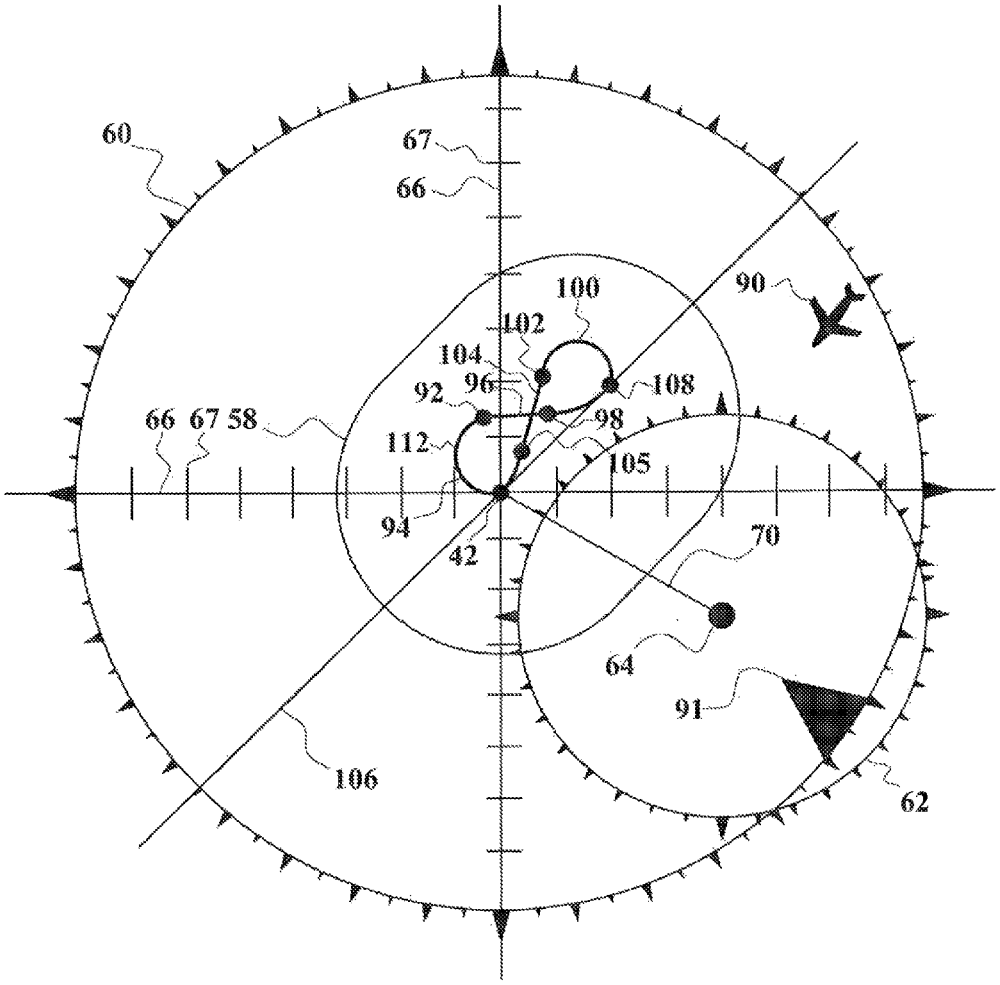
FIG. 12 is a graphical representation of a third figure eight holding pattern generated using an embodiment disclosed herein.

Pattern 3 (shown as 112 in FIG. 12—initial right turn when wind is from the left):
Input direction wind is blowing from, in degrees, e.g., 125; (Indicated by triangle 91.)
Xproduct=−0.98
Wind blowing from=125 degrees.
Wind blowing toward=305 degrees.
Indicated inbound airspeed=186 knots.
Altitude-corrected inbound airspeed=241 knots.
Inbound ground speed=244 knots.
Wind corrected inbound bearing=210 degrees.
Enter the holding pattern at tangent point 108 (on inbound turn 100) and turn RIGHT until bearing is 250.0 degrees (at post 98, the end of the inbound turn and the beginning of the inbound leg 96).
Level and fly that bearing until the bearing back to NAVAID is 129.6 degrees (at post 92, the end of the inbound leg and the beginning of the outbound turn 94).
(At that point) Turn LEFT (passing through the FIX 42) until bearing is 30.0 degrees (at post 105, the end of the outbound turn and the beginning of the outbound leg 104).
Level and fly that bearing (on inbound turn 100) until the bearing back to NAVAID is 144.3 degrees (at post 102).
Begin RIGHT turn (on inbound turn 100) and repeat circuit.
Start of inbound leg to NAVAID slant DME=12.21 NM.
Latitude of start of inbound leg=N 31 degrees, 48.57 minutes.
Longitude of start of inbound leg=W 97 degrees, 11.90 minutes.
Area enclosed in blue is a subset of FAA Basic Template 15.
Inbound leg=6.10 NM, Template 15 LM=9.60 NM, LI=7.70 NM.

Figure 13:
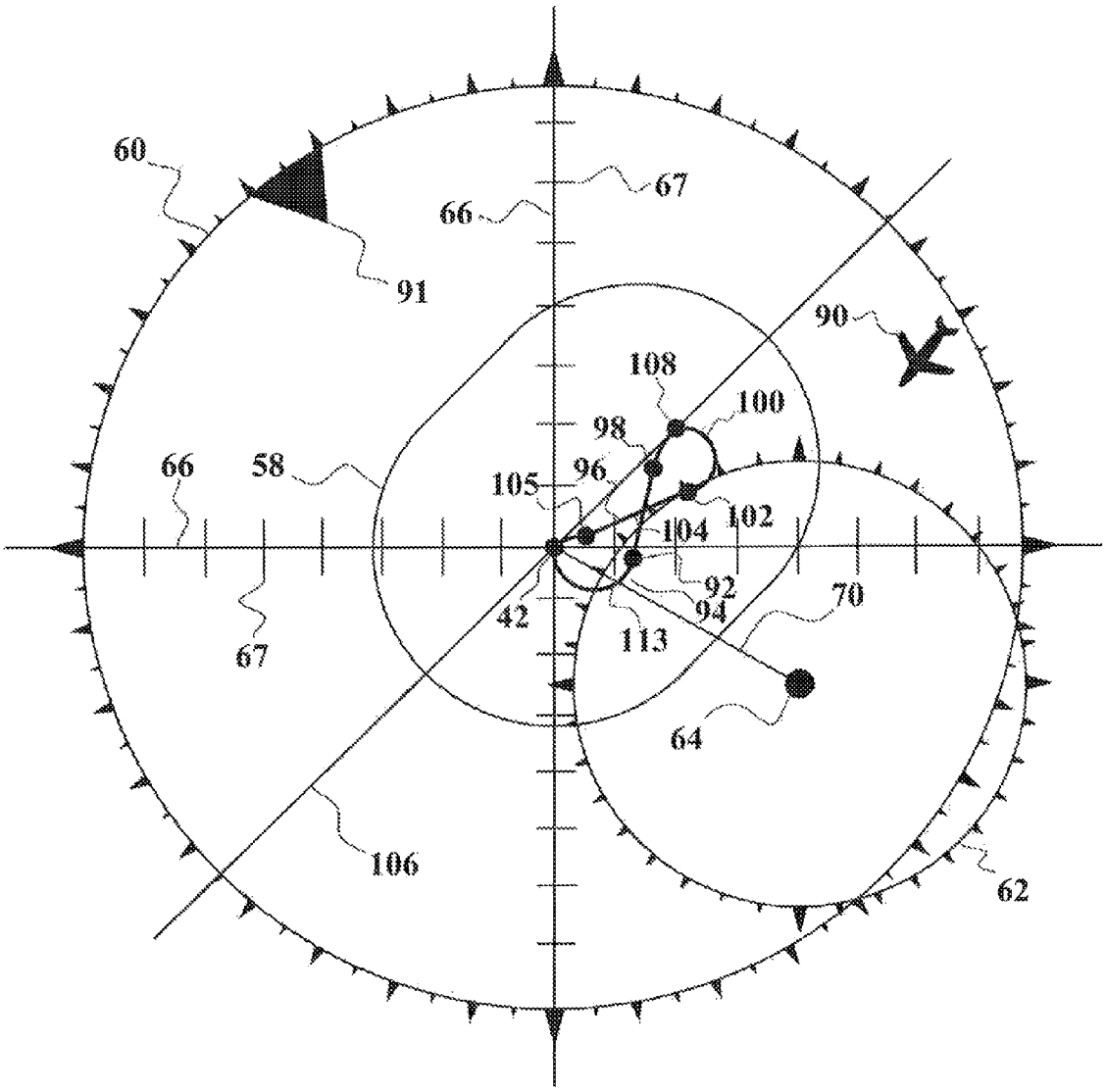
FIG. 13 is a graphical representation of a fourth figure eight holding pattern generated using an embodiment disclosed herein.

Pattern 4 (113 shown in FIG. 13—initial left turn when wind is from the right):
Indicated inbound airspeed=186 knots.
Altitude-corrected inbound airspeed=241 knots.
Inbound ground speed=244 knots.
Wind corrected inbound bearing=240 degrees.
Enter the holding pattern at tangent point 108 (on inbound turn 100) turn LEFT until bearing is 200.0 degrees (at post 98, the end of the inbound turn and the start of the inbound leg 104).
Level and fly that bearing until the bearing back to NAVAID is 126.9 degrees (at post 92, the end of the inbound leg and the start of outbound turn 94).

Figure 14:
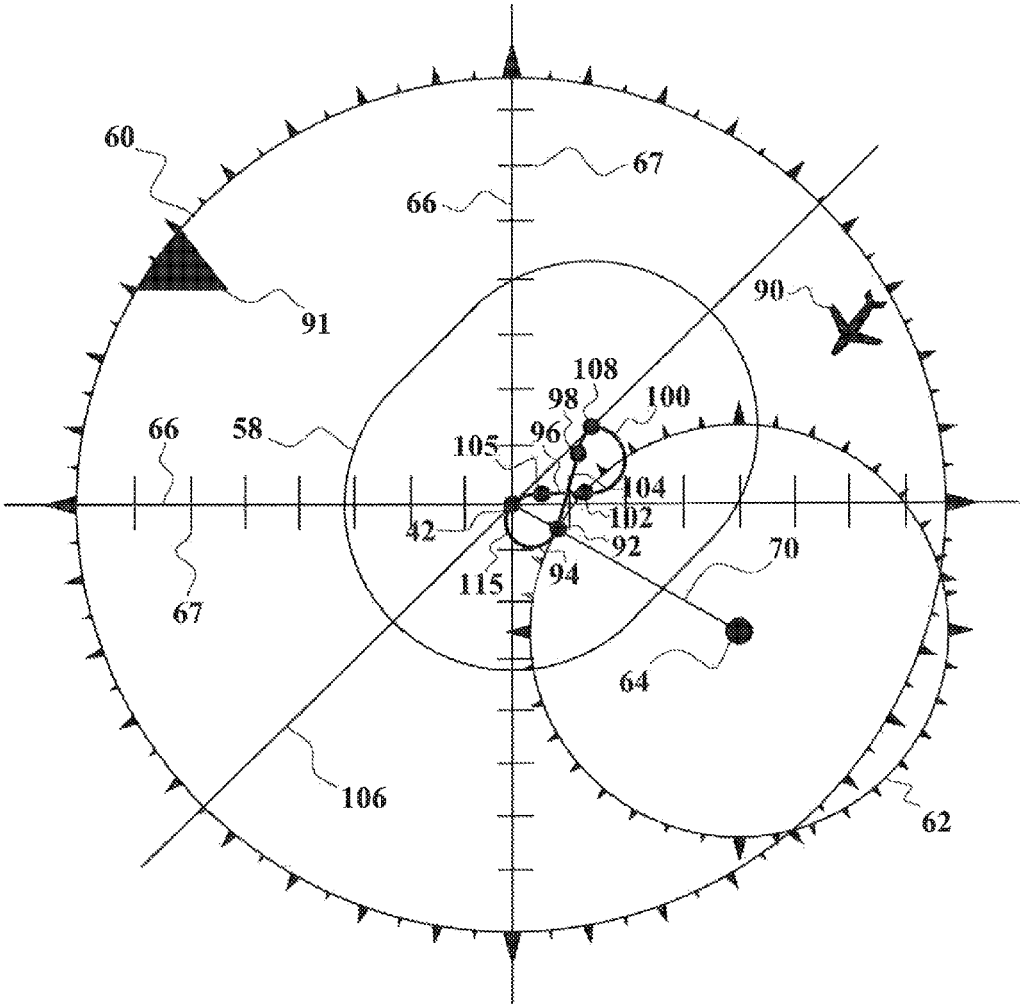
FIG. 14 is a graphical representation of a fifth figure eight holding pattern generated using an embodiment disclosed herein.

At post 92 turn RIGHT (passing through the FIX 42) until bearing is 60.0 degrees (at post 105, the end of the outbound turn and the start of outbound leg 96).
Level and fly that bearing until the bearing back to NAVAID is 149.5 degrees (at post 102). Begin LEFT turn (on inbound turn 100) and repeat circuit.
Start of inbound leg to NAVAID slant DME=12.21 NM.
Latitude of start of inbound leg=N 31 degrees, 48.57 minutes.
Longitude of start of inbound leg=W 97 degrees, 11.90 minutes.
Area enclosed in oval 58 is a subset of FAA Basic Template 15.
Inbound leg=6.10 NM, Template 15 LM=9.60 NM, LI=7.70 NM Pattern 5 (115 shown in FIG. 14—initial left turn when wind is from the right):
Input direction wind is blowing from, in degrees. 305; (Indicated by triangle 91.)
Wind blowing from=305 degrees.
Wind blowing toward=125 degrees.
Indicated inbound airspeed=186 knots.
Altitude-corrected inbound airspeed=241 knots.
Inbound ground speed=221 knots.
Wind corrected inbound bearing=240 degrees.
Enter the holding pattern at tangent point 108 (on inbound turn 100) turn LEFT until bearing is 205.0 degrees (at post 98, the end of the inbound turn and the start of inbound leg 104).
Level and fly that bearing until the bearing back to NAVAID is 121.5 degrees (at post 92, the end of the inbound leg and the start of outbound turn 94).
(At that point) Turn RIGHT (passing through the FIX 42) until bearing is 78.0 degrees (at post 105, the end of the outbound turn and the start of the outbound leg 96).
Level and fly that bearing until the bearing back to NAVAID is 136.9 degrees (at post 102).
Begin LEFT turn (on inbound turn 100) and repeat circuit.
Start of inbound leg to NAVAID slant DME=12.08 NM.
Latitude of start of inbound leg=N 31 degrees, 48.16 minutes.
Longitude of start of inbound leg=W 97 degrees, 12.37 minutes.
Area enclosed in blue is a subset of FAA Basic Template 15.
Inbound leg=5.52 NM, Template 15 LM=9.60 NM, LI=7.70 NM.

Figure 15:
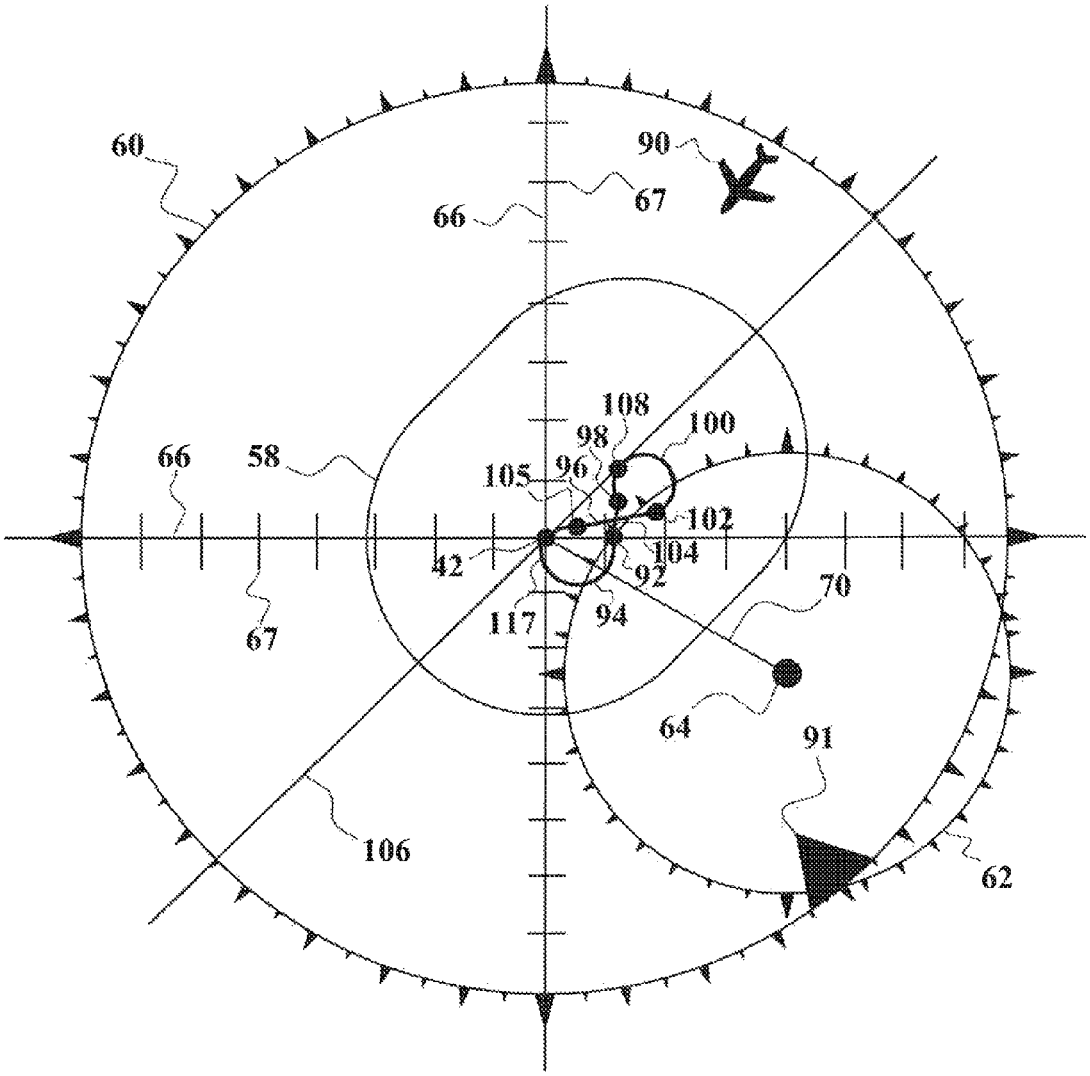
FIG. 15 is a graphical representation of a sixth figure eight holding pattern generated using an embodiment disclosed herein.

Pattern 6 (117 shown in FIG. 15—initial left turn when wind is from the left):
Input direction wind is blowing from, in degrees. 145; (Indicated by triangle 91.)
Xproduct=−0.98
Wind blowing from=145 degrees.
Wind blowing toward=325 degrees.
Indicated inbound airspeed=186 knots.
Altitude-corrected inbound airspeed=241 knots.
Inbound ground speed=221 knots.
Wind corrected inbound bearing=210 degrees.
Enter the holding pattern at FIX 42 (on outbound turn 94) and turn LEFT until bearing is 12.0 degrees (at post 92, the end of outbound turn 94 and the start of outbound leg 104).
Level and fly that bearing until the bearing back to NAVAID is 138.5 degrees (at post 98, the end of the outbound leg and the start of inbound turn 100).
(At post 98) Turn RIGHT (passing through tangent point 108) until bearing is 245.0 degrees (at post 102, the end of the inbound turn and the start of inbound leg 96).
Level and fly that bearing until the bearing back to NAVAID is 125.3 degrees (at post 105, the end of the inbound leg and the start of outbound turn 94).
Begin LEFT turn (on outbound turn 94) and repeat circuit.
Start of inbound leg to NAVAID slant DME=12.08 NM.
Latitude of start of inbound leg=N 31 degrees, 48.16 minutes.
Longitude of start of inbound leg=W 97 degrees, 12.37 minutes.
Area enclosed in blue is a subset of FAA Basic Template 15.
Inbound leg=5.52 NM, Template 15 LM=9.60 NM, LI=7.70 NM.

In an embodiment, a holding pattern disclosed herein comprises an inbound leg, an outbound turn, an outbound leg, and an inbound turn. In calculating the holding pattern for an aircraft, an FMS in the aircraft (or another aboard system) may first calculate an inbound leg starting point using an inbound leg course, an inbound leg duration, and an airspeed. Second, the FMS may calculate a curved path trajectory for the aircraft using the airspeed for the aircraft, the wind speed, the wind direction, and a rate-of-turn for the aircraft (e.g., a rate (in degrees per second) at which the aircraft is turning direction). Note that the curved path trajectory may be a path that the aircraft will fly when the aircraft turns at the rate-of-turn and at the airspeed when the aircraft is subjected to the wind speed and the wind direction.

In an embodiment, the curved path trajectory may be a spiral path that comprises an outbound turn portion and an inbound turn portion. For example, the outbound leg may be a line that is tangent to both the outbound turn portion and the inbound turn portion and is not coincident with the inbound leg. Thus, the FMS may orient at least part of the outbound turn portion on the holding fix at the holding fix such that the inbound course is tangent to the outbound turn portion at the holding fix. The FMS may further orient at least part of the inbound turn portion on the inbound leg starting point such that the inbound course is tangent to the inbound turn portion at the holding fix. Furthermore, the FMS may determine the outbound leg for the holding pattern.

FIGS. 16-23 are flowcharts showing how an embodiment disclosed herein may be implemented using a computer program. They are for illustration only. Other types of computer programs may be used to implement an embodiment disclosed herein.

Figure 16:
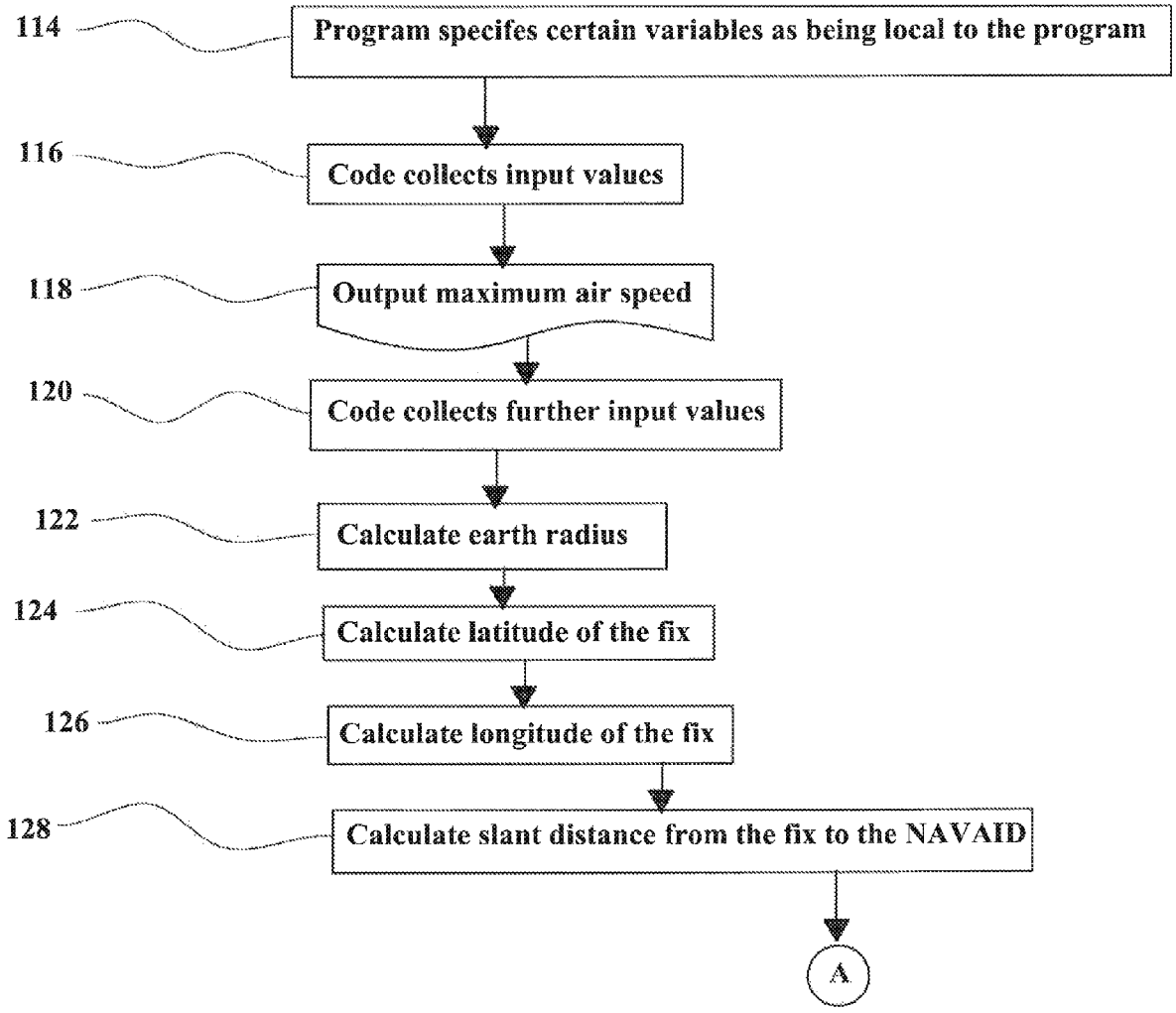
FIG. 16 is a first flow chart showing how an embodiment disclosed herein may be implemented using a computer program.

In FIG. 16, the program first specifies certain variables as being local to the program 114, such as local coordinates, hold bearing, airspeed, altitude, wind speed, etc. The code then collects input values 116, such as NAVAID latitude, longitude, elevation, aircraft type, and maximum speed. Maximum airspeed is then printed or otherwise outputted 118. The code again collects input values 120, such as altitude, and NAVAID to FIX distance and bearing. Earth radius is calculated 122. The latitude of the fix is calculated 124. The longitude of the fix is calculated 126. The slant distance from the fix to the NAVAID is then calculated 128.

Figure 17:
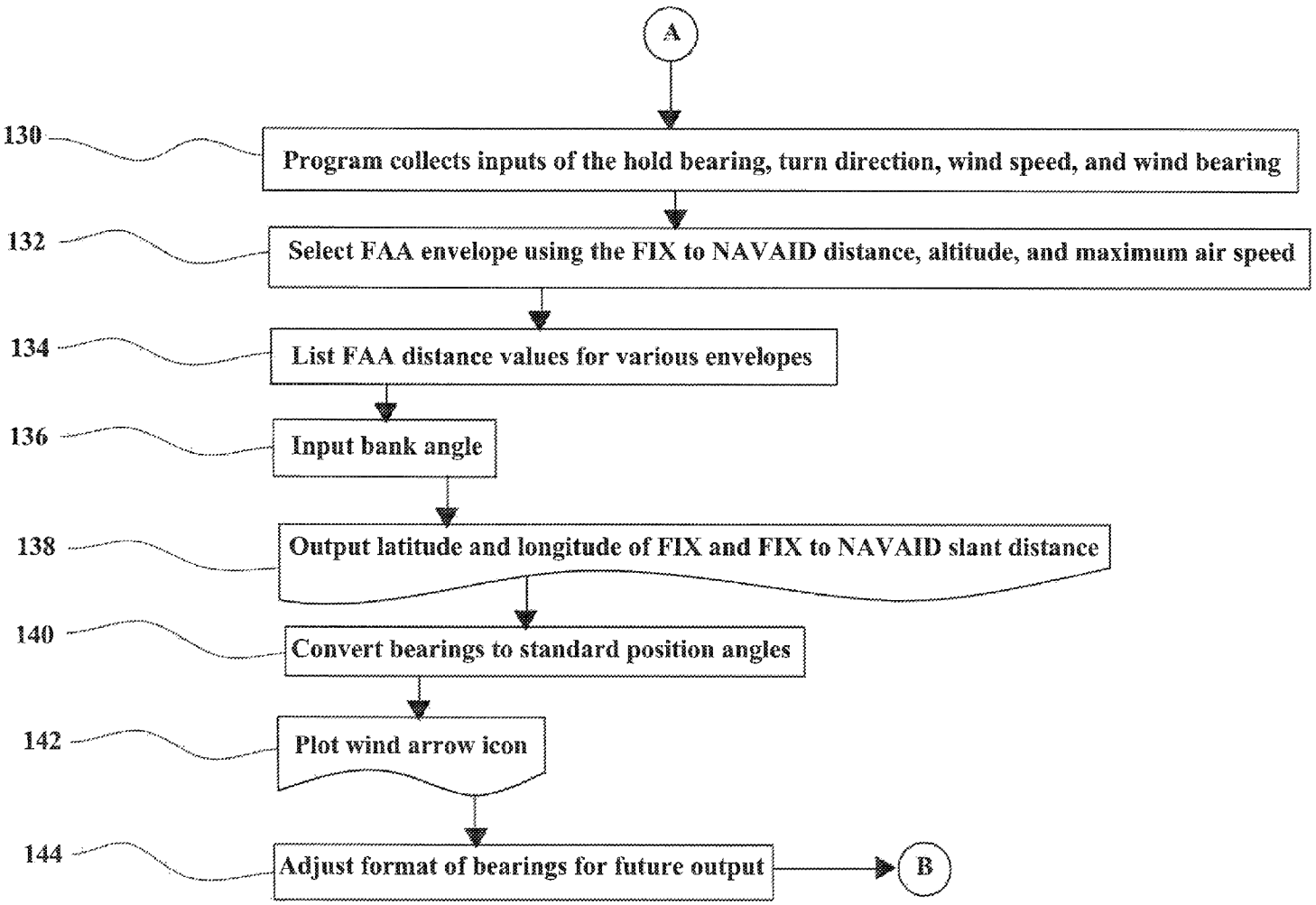
FIG. 17 is a second flow chart showing how an embodiment disclosed herein may be implemented using a computer program.

In FIG. 17, the program then collects inputs of the hold bearing, turn direction, wind speed, and wind bearing 130. The FAA envelope is selected using the FIX to NAVAID distance, altitude, and maximum airspeed 132. FAA distance values for various envelopes are listed 134. The bank angle is inputted 136. The latitude and longitude of the FIX and FIX to NAVAID slant distance are printed or otherwise outputted 138. The bearings may be converted to standard position angles 140. A plot of an icon in the form of an arrow indicating direction is created 142. The format of bearings for future output is adjusted 144.

Figure 18:
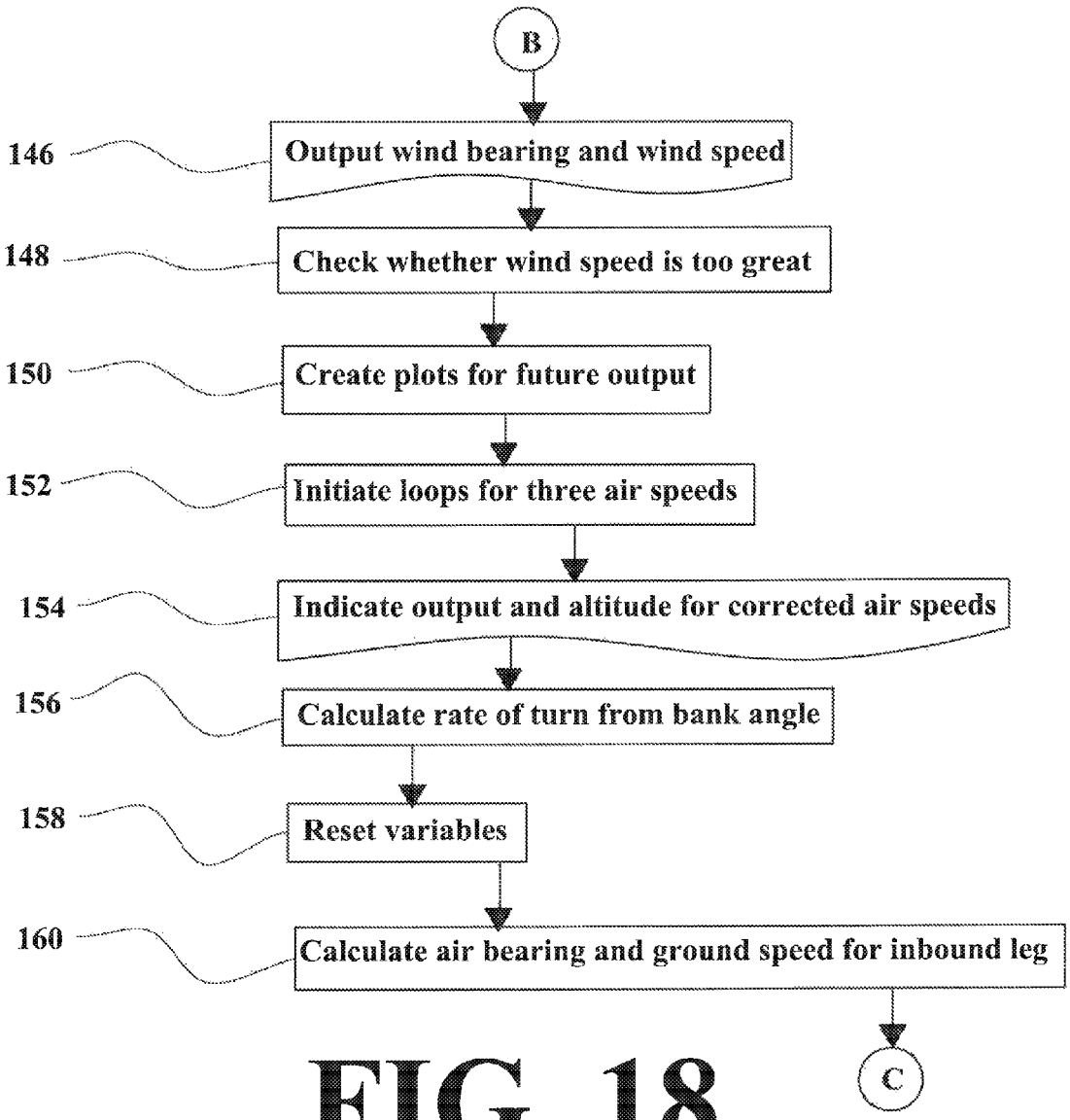
FIG. 18 is a third flow chart showing how an embodiment disclosed herein may be implemented using a computer program.

In FIG. 18, wind bearing and wind speed are printed or otherwise outputted 146. The program checks to see if wind speed is too great 148. Plots are created for future output 150. Loops for three airspeeds are initiated 152. Output and altitude-corrected airspeeds are indicated 154. Rate of turn from bank angle is calculated 156. Variables such as degrees per second and wind bearing are reset 158. Calculate the bearing and ground speed for the inbound leg are calculated 160.

Figure 19:
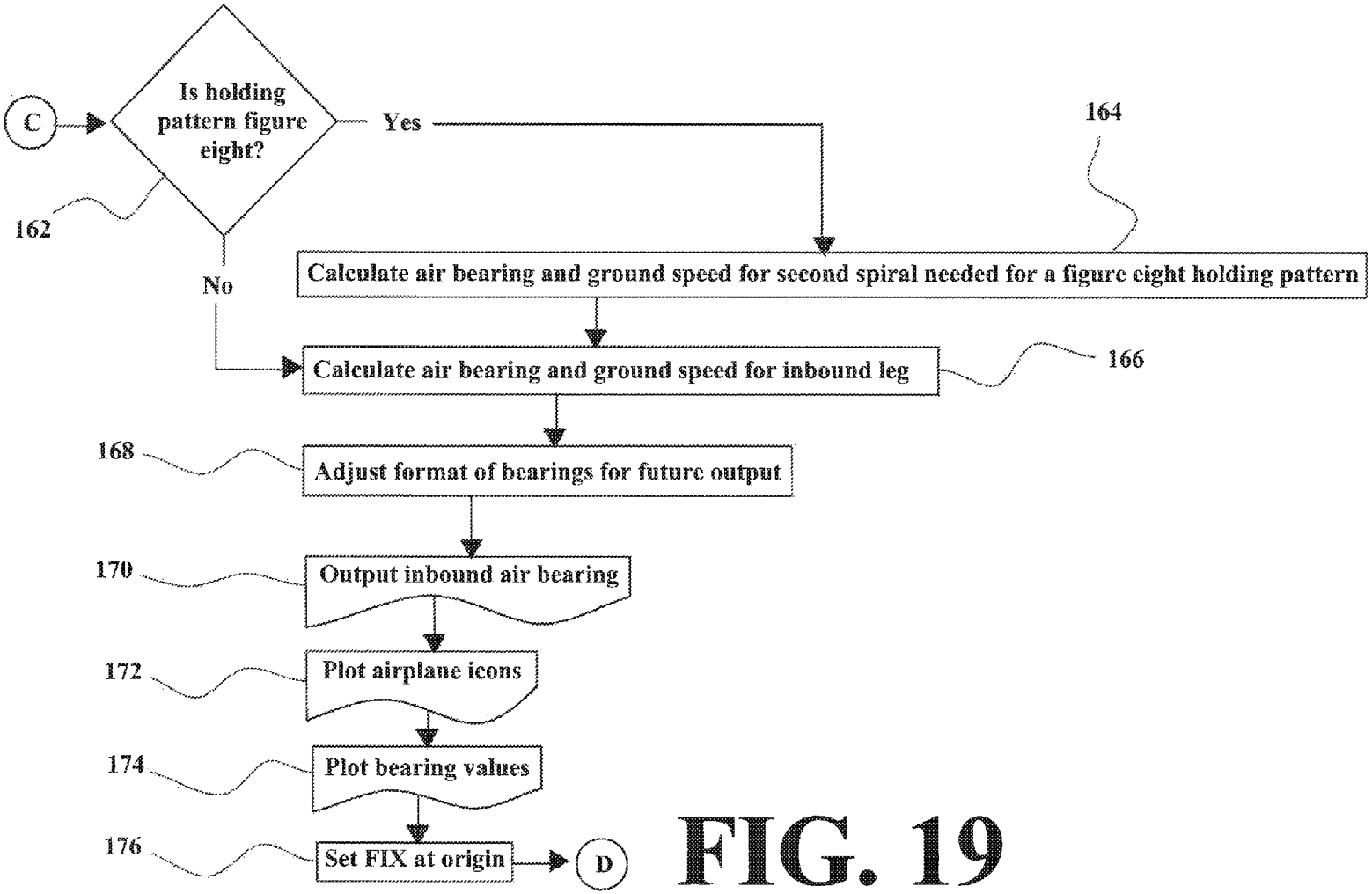
FIG. 19 is a fourth flow chart showing how an embodiment disclosed herein may be implemented using a computer program.

In FIG. 19, if the holding pattern is a figure eight 162, calculate the bearing and ground speed for the second spiral needed for a figure eight holding pattern 164. Then, regardless of the type of holding pattern, calculate bearing and ground speed for the inbound leg 166. Adjust the format of the bearings for future output 168. Output inbound bearing 170. Create plots to draw aircraft on graph 172. Create text plots to display bearing values on graph 174, and set the FIX at the origin (0, 0) 176. It should be understood that although information may be electronically displayed, such information may be sent to the flight director or autopilot without being displayed, that is, the displaying step may be optional.

Figure 20:
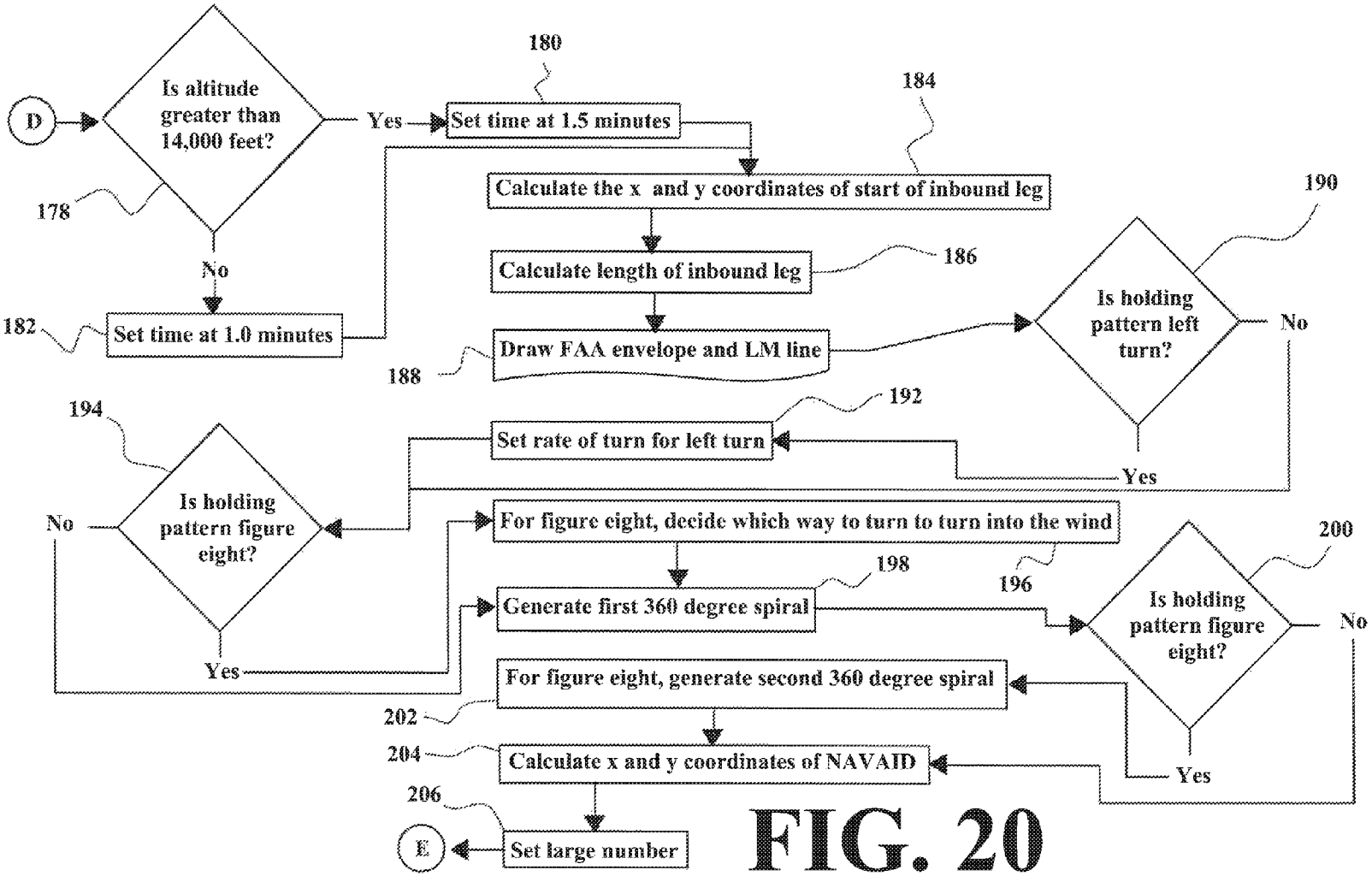
FIG. 20 is a fifth flow chart showing how an embodiment disclosed herein may be implemented using a computer program.

In FIG. 20, if the altitude is greater than 14,000 feet 178, set the time of the inbound leg to 1.5 minutes 180, else set the time of the inbound leg to 1.0 minutes 182. Calculate the x- and y-coordinates of the start of the inbound leg 184. Calculate the length of the inbound leg 186. The program then draws the FAA envelope and the LM line (68 in FIG. 4-9 or 106 in FIGS. 10-12) 188. If the holding pattern is for a left turn 190, set rate of turn 192. If the holding pattern is a figure eight 194, the computer decides which way to turn into the wind 196. Regardless of the type of holding pattern, next it generates a first 360-degree spiral 198. If and only if the holding pattern is a figure eight 200, it generates a second 360-degree spiral 202. Regardless of the type of holding pattern, it next calculate the x- and y-coordinates of the NAVAID 204. It then sets a large number 206, which is the maximum number of degrees that the wind direction can vary for the holding pattern.

Figure 21:
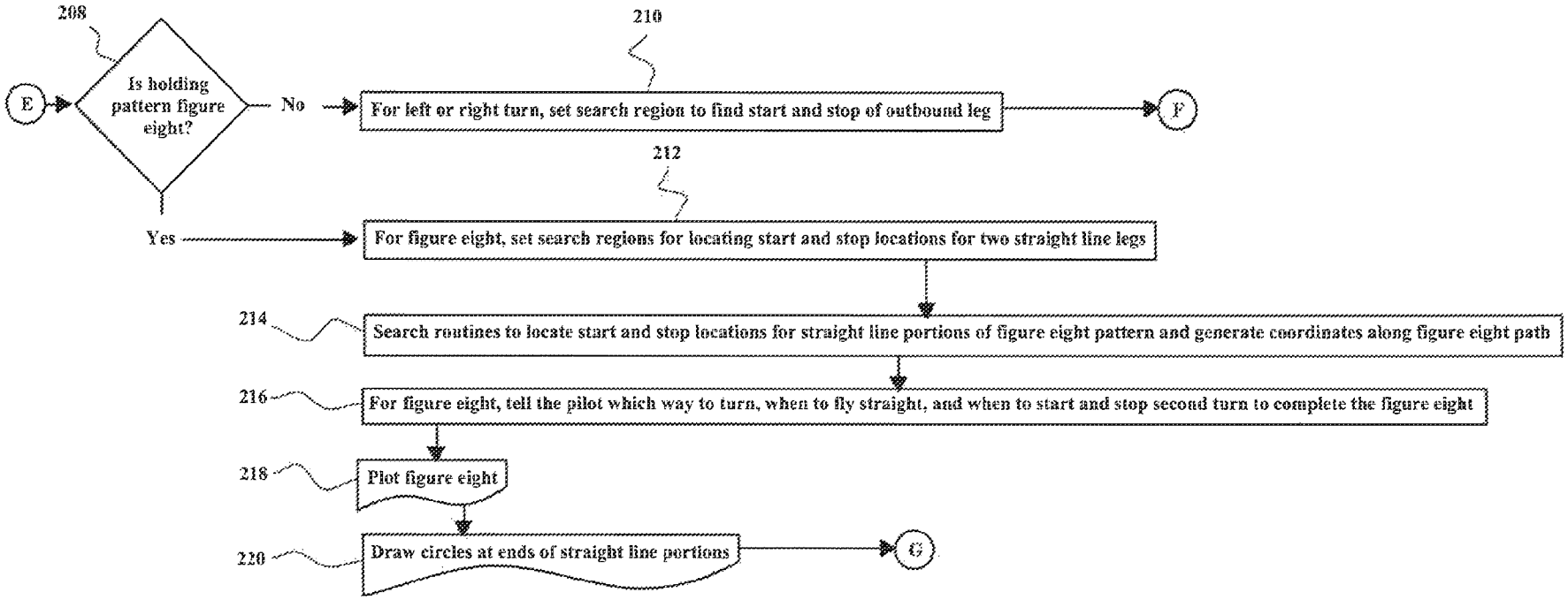
FIG. 21 is a sixth flow chart showing how an embodiment disclosed herein may be implemented using a computer program.
Figure 22:
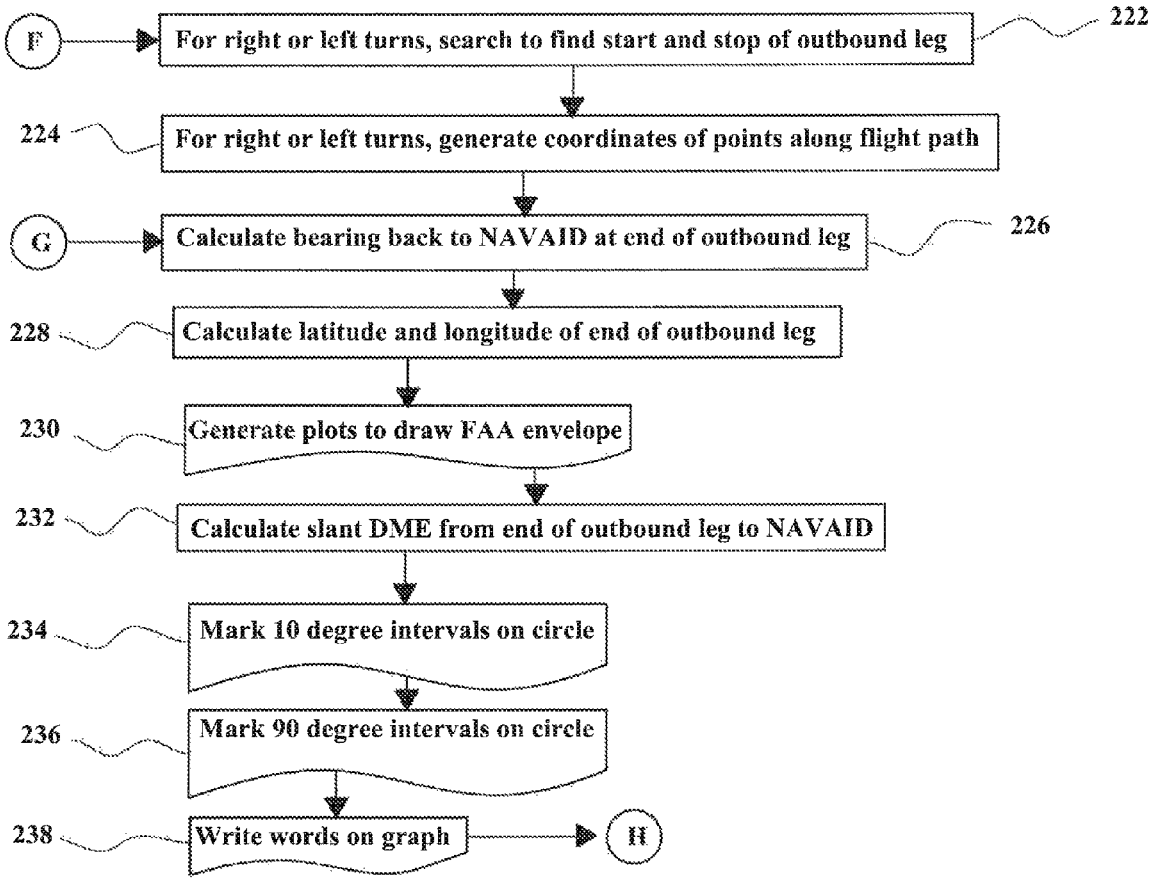
FIG. 22 is a seventh flow chart showing how an embodiment disclosed herein may be implemented using a computer program.

In FIG. 21, if the holding pattern is not a figure eight 208 (i.e., is a left or right turn), set the search region to find start and stop of the outbound leg 210, and proceed to F in FIG. 22. If the holding pattern is a figure eight, set search regions for locating start and stop locations for two straight line legs 212, perform search routines to locate start and stop locations for straight line portions of figure eight pattern and generate coordinates along the figure eight path 214, tell the pilot which way to turn, when to fly straight, and when to start and stop second turn to complete the figure eight 216, plot the figure eight 218, draw circles at the ends of the straight line portions 220, and proceed to G in FIG. 22.

In FIG. 22, for right or left turns, the program searches to find the start and stop of the outbound leg 222, and generate the coordinates of points along the flight path 224. For any kind of holding pattern, the program then calculates the bearing back to the NAVAID at end of outbound leg 226. Then it calculates the latitude and longitude of the end of the outbound leg 228. It generates the plots to draw the FAA envelope 230. It calculates the slant DME from the end of the outbound leg to the NAVAID 232. It generates plots, marking 10-degree intervals 234 on a circle, and marking 90-degree intervals 236 (with larger marks) on the circle. (It may modify the format of bearings for output). Then, it writes words on a graph or other display 238.

Figure 23:
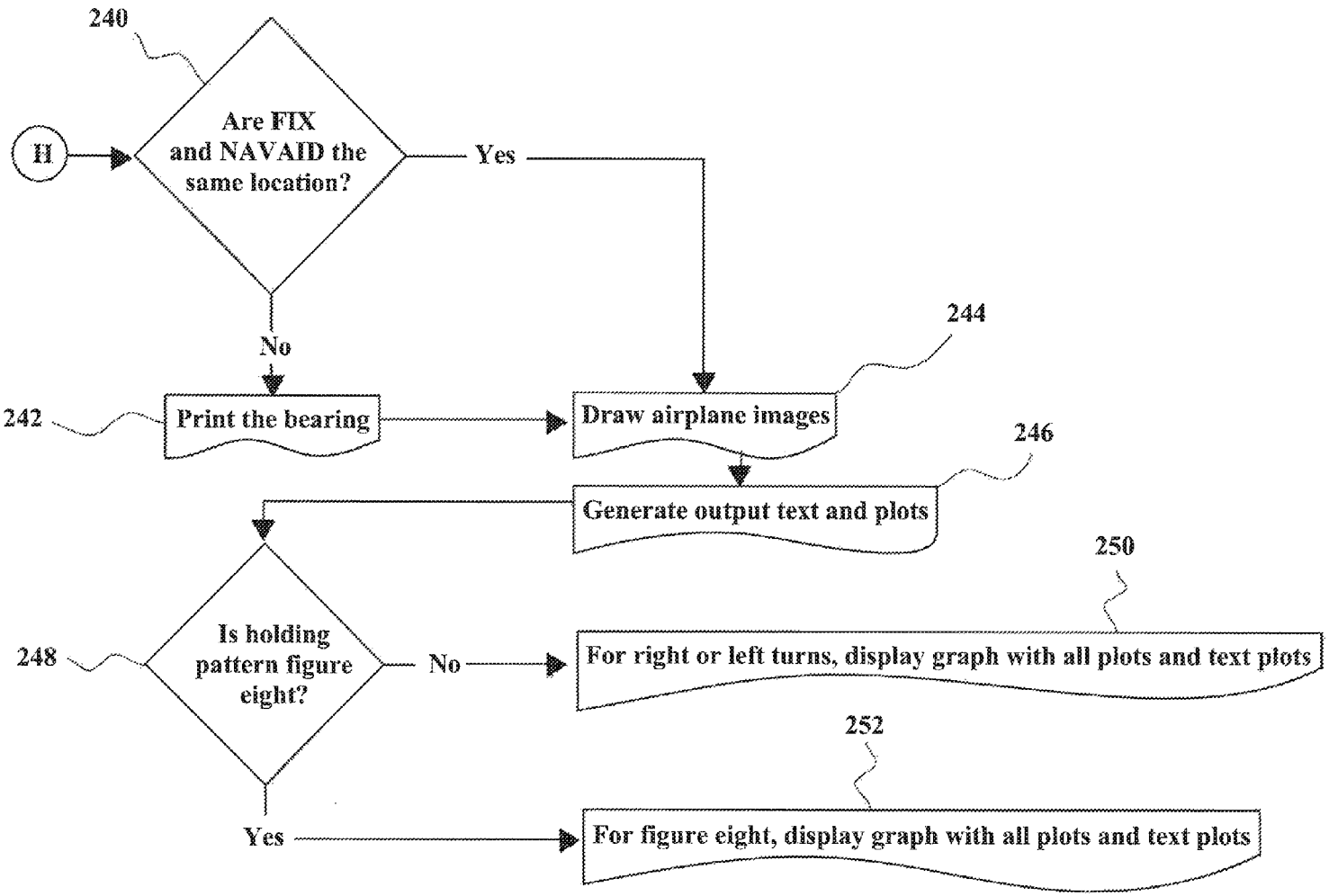
FIG. 23 is an eighth flow chart showing how an embodiment disclosed herein may be implemented using a computer program.

In FIG. 23, if FIX and NAVAID are not the same location 240, print the bearing 242. In either case, draw aircraft images 244, and generate output text and plots 246. If the holding pattern is not a figure eight 248, display the graph with all plots and text plots 250 for a left or right hand holding pattern. If the holding pattern is a figure eight, display the graph with all plots and text plots 252 for a figure eight holding pattern.

The aircraft disclosed herein includes many parts that work together. For example, an aircraft comprises an FMS, an airframe attached to the FMS, at least one engine attached to the airframe, and an avionics system attached to the airframe and the FMS. The airframe makes up at least part of the mechanical structure of the aircraft. Any suitable type of engine may be used in the aircraft. The avionics system may include electronic systems for various purposes such as communications, navigation, the display and management of multiple systems. There may be hundreds of systems known in the art that are fitted to aircraft to perform individual functions.

Figure 24:
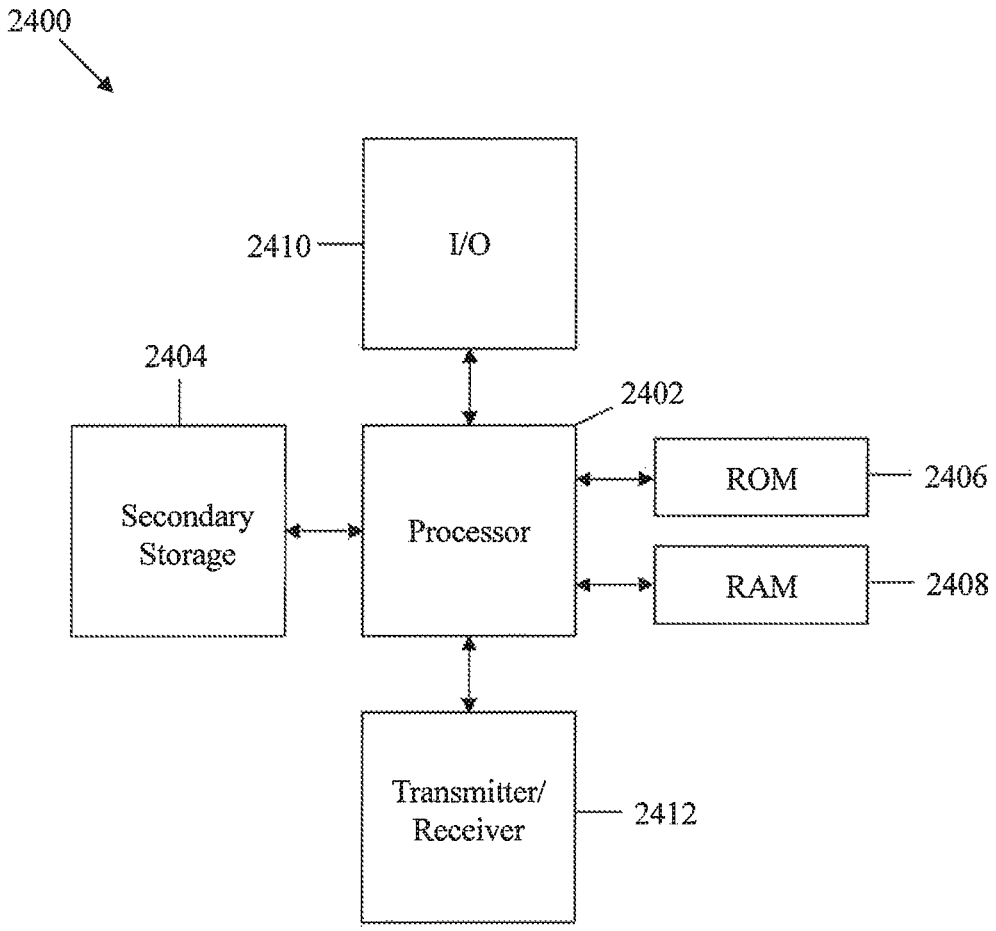
FIG. 24 is a graphical representation of an embodiment of a computer system.

The schemes described above may be implemented on a computer system or a network component with sufficient processing power, memory resources, and network throughput capability to handle the necessary workload placed upon it. FIG. 24 illustrates an embodiment of a computer system or network node 2400 suitable for implementing one or more embodiments of the systems disclosed herein, such as a calculator, FMS, or a flight control system described above. The computer system 2400 may be placed aboard an aircraft disclosed herein or may be located elsewhere communicating with the aircraft.

The computer system 2400 includes a processor 2402 that is in communication with memory devices including secondary storage 2404, read only memory (ROM) 2406, random access memory (RAM) 2408, input/output (I/O) devices 2410, and transmitter/receiver (transceiver) 2412. Although illustrated as a single processor, the processor 2402 is not so limited and may comprise multiple processors. The processor 2402 may be implemented as one or more central processor unit (CPU) chips, cores (e.g., a multi-core processor), field-programmable gate arrays (FPGAs), application specific integrated circuits (ASICs), and/or digital signal processors (DSPs). The processor 2402 may be configured to implement at least part of any of the schemes described herein, including the methods shown in FIGS. 16-23. The processor 2402 may be implemented using hardware or a combination of hardware and software.

The secondary storage 2404 typically comprises one or more disk drives or tape drives and is used for non-volatile storage of data and as an over-flow data storage device if the RAM 2408 is not large enough to hold all working data. The secondary storage 2404 may be used to store programs that are loaded into the RAM 2408 when such programs are selected for execution. The ROM 2406 is used to store instructions and perhaps data that are read during program execution. The ROM 2406 is a non-volatile memory device that typically has a small memory capacity relative to the larger memory capacity of the secondary storage 2404. The RAM 2408 is used to store volatile data and perhaps to store instructions. Access to both the ROM 2406 and the RAM 2408 is typically faster than to the secondary storage 2404.

The transmitter/receiver 2412 may serve as an output and/or input device of the computer system 2400. For example, if the transmitter/receiver 2412 is acting as a transmitter, it may transmit data out of the computer system 2400. If the transmitter/receiver 2412 is acting as a receiver, it may receive data into the computer system 2400. Further, the transmitter/receiver 2412 may include one or more optical transmitters, one or more optical receivers, one or more electrical transmitters, and/or one or more electrical receivers. The transmitter/receiver 2412 may take the form of modems, modem banks, Ethernet cards, universal serial bus (USB) interface cards, serial interfaces, token ring cards, fiber distributed data interface (FDDI) cards, and/or other well-known network devices. The transmitter/receiver 2412 may enable the processor 2402 to communicate with an Internet or one or more intranets. The I/O devices 2410 may be optional or may be detachable from the rest of the computer system 2400. The I/O devices 2410 may include a display, such as a liquid crystal display (LCD), a light emitting diode (LED) display, or any other suitable type of display. The I/O devices 2410 may also include one or more keyboards, mice, or track balls, or other well-known input devices.

It is understood that by programming and/or loading executable instructions onto the computer system 2400, at least one of the processor 2402, the secondary storage 2404, the RAM 2408, and the ROM 2406 are changed, transforming the computer system 2400 in part into a particular machine or apparatus (e.g. a transmission or receiving system having the functionality taught by the present disclosure). The executable instructions may be stored on the secondary storage 2404, the ROM 2406, and/or the RAM 2408 and loaded into the processor 2402 for execution. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an ASIC, because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner, as a machine controlled by a new ASIC is a particular machine or apparatus, likewise a computer that has been programmed and/or loaded with executable instructions may be viewed as a particular machine or apparatus.

Any processing of the present disclosure may be implemented by causing a processor (e.g., a general purpose multicore processor) to execute a computer program. In this case, a computer program product can be provided to a computer or a network device using any type of non-transitory computer readable media. The computer program product may be stored in a non-transitory computer readable medium in the computer or the network device. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), compact disc read only memory (CD-ROM), compact disc recordable (CD-R), compact disc rewritable (CD-R/W), digital versatile disc (DVD), Blu-ray (registered trademark) disc (BD), and semiconductor memories (such as mask ROM, programmable ROM (PROM), erasable PROM), flash ROM, and RAM). The computer program product may also be provided to a computer or a network device using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_1+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. The use of the term "about" means+/−10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

We claim:

1. An apparatus comprising:

a memory; and a processor coupled to the memory and configured to provide automated guidance for an aircraft by implementing the following steps:

receive holding instructions for the aircraft, wherein the holding instructions comprise a holding fix, a holding direction, and an inbound leg course;

obtain an airspeed for the aircraft;

obtain a wind speed and a wind direction affecting the aircraft;

calculate a holding pattern for the aircraft using the holding instructions, the wind speed, the wind direction, an inbound leg duration, and the airspeed;

obtain Federal Aviation Administration (FAA) holding pattern protected airspace template limits associated with the holding fix;

determine that the holding pattern is not within the FAA holding pattern protected airspace template limits;

calculate a different airspeed for the aircraft that will keep the holding pattern within the FAA holding pattern protected airspace template limits;

indicate that the airspeed will need to be changed to the different airspeed in order for the aircraft to remain in the FAA holding pattern protected airspace template limits; and present the holding pattern and the FAA holding pattern protected airspace template limits to a flight crew member on the aircraft.

2. The apparatus of claim 1, wherein the processor is configured to present the holding pattern and the FAA holding pattern protected airspace template limits to the flight crew member prior to the aircraft arriving at the holding fix.

3. The apparatus of claim 1, wherein the memory and processor are part of a flight management system (FMS), and wherein the apparatus further comprises an airframe attached to the FMS, at least one engine attached to the airframe, and an avionics system attached to the airframe and the FMS.

4. The apparatus of claim 1, wherein the processor is further configured to:

receive one or more updated parameters that affect the holding pattern, wherein the updated parameters comprise a change in the holding instructions, a change in wind speed, a change in wind direction, or combinations thereof; and recalculate the holding pattern for the aircraft using the updated parameters; and verifies that the recalculated holding pattern will keep the holding pattern within the FAA holding pattern protected airspace template limits, wherein the holding pattern presented to the flight crew member comprises the holding pattern that is recalculated using the updated parameters.

5. The apparatus of claim 1, wherein calculating the different airspeed for the aircraft that will keep the holding pattern within the FAA holding pattern protected airspace template limits comprises recalculating the holding pattern for the aircraft using the holding instructions, the wind speed, the wind direction, the inbound leg duration, and the different airspeed, wherein indicating that the airspeed will need to be changed to the different airspeed in order for the aircraft to remain in the FAA holding pattern protected airspace template limits comprises instructing the flight crew to change the airspeed to the different airspeed, and wherein the holding pattern presented to the flight crew member comprises the holding pattern that is recalculated using the different airspeed.

6. The apparatus of claim 1, wherein calculating the different airspeed for the aircraft that will keep the holding pattern within the FAA holding pattern protected airspace template limits comprises recalculating the holding pattern for the aircraft using the holding instructions, the wind speed, the wind direction, the inbound leg duration, and the different airspeed, wherein indicating that the airspeed will need to be changed to the different airspeed in order for the aircraft to remain in the FAA holding pattern protected airspace template limits comprises instructing the aircraft to change the airspeed to the different airspeed, and wherein the holding pattern presented to the flight crew member comprises the holding pattern that is recalculated using the different airspeed.

7. The apparatus of claim 1, wherein the different airspeed is between a minimum hold speed for the aircraft and a maximum hold speed for the aircraft, and wherein the processor is further configured to:

change the holding pattern from a racetrack-style holding pattern to a figure-eight holding pattern when the different airspeed will not keep the holding pattern within the FAA holding pattern protected airspace template limits; and calculate the figure-eight holding pattern for the aircraft using the holding instructions, the wind speed, the wind direction, and the inbound leg duration, and wherein the holding pattern presented to the flight crew member comprises the holding pattern that is recalculated using the different airspeed.

8. The apparatus of claim 1, wherein the processor is further configured to provide instructions to an autopilot or flight director to fly the aircraft in the holding pattern.

9. The apparatus of claim 1, wherein the holding pattern and the FAA holding pattern protected airspace template limits are graphically presented to the flight crew member on the aircraft, and wherein no part of the holding pattern is coincident with the FAA holding pattern protected airspace template limits.

10. An apparatus comprising:

a memory; and a processor coupled to the memory and configured to provide guidance for an aircraft by implementing the following steps:

receiving holding instructions for the aircraft, wherein the holding instructions comprise a holding fix, a holding direction, and an inbound leg course;

obtaining an airspeed for the aircraft;

obtaining a wind speed and a wind direction affecting the aircraft;

calculating a holding pattern for the aircraft using the holding instructions, the wind speed, the wind direction, an inbound leg duration, and the airspeed;

obtaining Federal Aviation Administration (FAA) holding pattern protected airspace template limits associated with the holding fix; and presenting the holding pattern and the FAA holding pattern protected airspace template limits to a flight crew member on the aircraft, wherein the holding pattern comprises an inbound leg, an outbound turn, an outbound leg, and an inbound turn, and wherein the processor, in being configured to calculate the holding pattern for the aircraft, is configured to:

calculate an inbound leg starting point using the inbound leg course, the inbound leg duration, and the airspeed;

calculate a curved path trajectory for the aircraft using the airspeed, the wind speed, the wind direction, and a rate-of-turn for the aircraft, wherein the curved path trajectory is a path the aircraft will fly when the aircraft turns at the rate-of-turn and at the airspeed when the aircraft is subjected to the wind speed and the wind direction, and wherein the curved path trajectory comprises an outbound turn portion and an inbound turn portion;

orient at least part of the outbound turn portion on the holding fix at the holding fix such that the inbound leg course is tangent to the outbound turn portion at the holding fix;

orient at least part of the inbound turn portion on the inbound leg starting point such that the inbound leg course is tangent to the inbound turn portion at the holding fix; and determine the outbound leg for the holding pattern, wherein the outbound leg is a line that is tangent to both the outbound turn portion and the inbound turn portion and is not coincident with the inbound leg.

11. A computer program product comprising computer executable instructions stored on a non-transitory computer readable medium that when executed by a processor causes a flight management system (FMS) to perform the following:

receive holding instructions for an aircraft, wherein the holding instructions comprise a holding fix, a holding direction, and an inbound leg course;

obtain an airspeed for the aircraft;

obtain a wind speed and a wind direction;

calculate a holding pattern for the aircraft using the holding instructions, the wind speed, the wind direction, an inbound leg duration, and the airspeed;

obtain protected airspace limits associated with the holding fix;

determine whether the holding pattern is within the protected airspace limits; and notify a flight crew member to take corrective action based upon at least part of the holding pattern not being within the protected airspace limits, wherein the holding pattern comprises an inbound leg, an outbound turn, an outbound leg, and an inbound turn, and wherein the computer executable instructions, when executed by the processor, further cause the FMS to:

calculate an inbound leg starting point using the inbound leg course, the inbound leg duration, and the airspeed;

calculate a curved path trajectory for the aircraft using the airspeed, the wind speed, the wind direction, and a rate-of-turn for the aircraft, wherein the curved path trajectory is a path the aircraft will fly when the aircraft turns at the rate-of-turn and at the airspeed when the aircraft is subjected to the wind speed and the wind direction, and wherein the curved path trajectory comprises an outbound turn portion and an inbound turn portion;

calculate the outbound turn portion of the curved path trajectory for the aircraft using the airspeed for the aircraft, the wind speed, the wind direction, and the rate-of-turn for the aircraft, wherein the curved path trajectory is the path the aircraft will fly when the aircraft turns at the rate-of-turn and at the airspeed when the aircraft is subjected to the wind speed and the wind direction, and wherein the outbound turn portion intersects the holding fix such that the inbound leg course is tangent to the outbound turn portion at the holding fix;

calculate the inbound turn portion of the curved path trajectory for the aircraft using the airspeed for the aircraft, the wind speed, the wind direction, and the rate-of-turn for the aircraft, wherein the inbound turn portion does not intersect the outbound turn portion, and wherein the inbound turn portion intersects the inbound leg starting point such that the inbound leg course is tangent to the inbound turn portion at the inbound leg starting point; and determine the outbound leg for the holding pattern, wherein the outbound leg is a line that is tangent to both the outbound turn portion and the inbound turn portion and is not the same as the inbound leg.

12. The computer program product of claim 11, wherein the computer executable instructions, when executed by the processor, further cause the FMS to:

receive one or more updated parameters that affect the holding pattern, wherein the updated parameters comprise a change in the airspeed, a change in the holding instructions, a change in wind speed, a change in wind direction, or combinations thereof; and recalculate the holding pattern for the aircraft using the updated parameters, wherein the holding pattern presented to the flight crew member comprises the holding pattern that is recalculated using the updated parameters.

13. The computer program product of claim 11, wherein the computer executable instructions, when executed by the processor, further cause the FMS to determine whether a different airspeed will keep the holding pattern within the protected airspace limits when at least part of the calculated holding pattern is not within the protected airspace limits.

14. The computer program product of claim 13, wherein the computer executable instructions, when executed by the processor, further cause the FMS to:

recalculate the holding pattern for the aircraft using the holding instructions, the wind speed, the wind direction, the inbound leg duration, and the different airspeed when the different airspeed will keep the holding pattern within the protected airspace limits; and instruct the flight crew member to change the airspeed to the different airspeed, and wherein the holding pattern presented to the flight crew member comprises the holding pattern that is recalculated using the different airspeed.

15. The computer program product of claim 13, wherein the computer executable instructions, when executed by the processor, further cause the FMS to:

recalculate the holding pattern for the aircraft using the holding instructions, the wind speed, the wind direction, the inbound leg duration, and the different airspeed when the different airspeed will keep the holding pattern within the protected airspace limits; and instruct the aircraft to change the airspeed to the different airspeed, and wherein the holding pattern presented to the flight crew member comprises the holding pattern that is recalculated using the different airspeed.

16. The computer program product of claim 13, wherein the different airspeed is between a minimum hold speed for the aircraft and a maximum hold speed for the aircraft, and wherein the computer executable instructions, when executed by the processor, further cause the FMS to:

change the holding pattern from a racetrack-style holding pattern to a figure-eight holding pattern when the different airspeed will not keep the holding pattern within the protected airspace limits; and calculate the figure-eight holding pattern for the aircraft using the holding instructions, the wind speed, the wind direction, and the inbound leg duration, and wherein the holding pattern presented to the flight crew member comprises the holding pattern that is recalculated using the different airspeed.

17. The computer program product of claim 11, wherein the computer executable instructions, when executed by the processor, further cause the FMS to graphically present the holding pattern and the protected airspace limits to the flight crew member on the aircraft using avionics.

18. The computer program product of claim 11, wherein the computer executable instructions, when executed by the processor, further cause the FMS to provide instructions to an autopilot or flight director to fly the aircraft in the holding pattern.

19. The computer program product of claim 11, wherein no part of the holding pattern is coincident with the holding pattern protected airspace limits, and wherein the holding pattern protected airspace limits are defined by a Federal Aviation Administration (FAA) holding pattern protected airspace template.

20. An aircraft, comprising:

an airframe;

at least one engine attached to the airframe;

an avionics system attached to the airframe; and a flight management system (FMS) attached to the airframe and in communication with the avionics system, wherein the FMS:

receives holding instructions for the aircraft, wherein the holding instructions comprise a holding fix, a holding direction, and an inbound leg course;

obtains an airspeed for the aircraft from the avionics system;

obtains a wind speed and a wind direction affecting the aircraft;

calculates a holding pattern for the aircraft using the holding instructions, the wind speed, the wind direction, an inbound leg duration, and the airspeed;

obtains Federal Aviation Administration (FAA) protected airspace lateral limits associated with the holding fix;

determines that the holding pattern is not within the FAA holding pattern protected airspace template limits;

calculates a different airspeed for the aircraft that will keep the holding pattern within the FAA holding pattern protected airspace template limits;

indicates the different airspeed required for the aircraft to remain in the FAA holding pattern protected airspace template limits; and graphically displays the holding pattern and the FAA protected airspace lateral limits to a flight crew member on the aircraft through either the FMS or the avionics system, wherein the holding pattern legs are not coincident with the FAA protected airspace lateral limits.

21. The aircraft of claim 20, wherein the FMS presents the holding pattern and the FAA protected airspace lateral limits to the flight crew member prior to the aircraft arriving at the holding fix.

22. The aircraft of claim 20, wherein the FMS further provides instructions to an autopilot or flight director to fly the aircraft in the holding pattern.

23. The aircraft of claim 20, wherein the FMS further:

receives an updated parameter that affects the holding pattern, wherein the updated parameter comprises a change in the holding instructions, a change in wind speed, a change in wind direction, or combinations thereof;

recalculates the holding pattern for the aircraft using the updated parameter; and verifies that the recalculated holding pattern will keep the holding pattern within the FAA holding pattern protected airspace template limits, wherein the holding pattern presented to the flight crew member comprises the holding pattern that is recalculated using the updated parameter.

24. The aircraft of claim 20, wherein calculating the different airspeed for the aircraft that will keep the holding pattern within the FAA holding pattern protected airspace template limits comprises recalculating the holding pattern for the aircraft using the holding instructions, the wind speed, the wind direction, the inbound leg duration, and the different airspeed, wherein indicating the different airspeed required for the aircraft to remain in the FAA holding pattern protected airspace template limits comprises instructing the flight crew to change the airspeed to the different airspeed, and wherein the holding pattern presented to the flight crew member comprises the holding pattern that is recalculated using the different airspeed.

25. The aircraft of claim 20, wherein calculating the different airspeed for the aircraft that will keep the holding pattern within the FAA holding pattern protected airspace template limits comprises recalculating the holding pattern for the aircraft using the holding instructions, the wind speed, the wind direction, the inbound leg duration, and the different airspeed, wherein indicates the different airspeed required for the aircraft to remain in the FAA holding pattern protected airspace template limits instructing the aircraft to change the airspeed to the different airspeed, and wherein the holding pattern presented to the flight crew member comprises the holding pattern that is recalculated using the different airspeed.

26. The aircraft of claim 20, wherein the different airspeed is between a minimum hold speed for the aircraft and a maximum hold speed for the aircraft, and wherein the FMS further:

changes the holding pattern from a racetrack-style holding pattern to a figure-eight holding pattern when the different airspeed will not keep the holding pattern within the FAA protected airspace lateral limits; and calculates the figure-eight holding pattern for the aircraft using the holding instructions, the wind speed, the wind direction, and the inbound leg duration, and wherein the holding pattern presented to the flight crew member comprises the holding pattern that is recalculated using the different airspeed.

27. The aircraft of claim 20, wherein the holding pattern comprises an inbound leg, an outbound turn, an outbound leg, and an inbound turn, and wherein the FMS, in being configured to calculate the holding pattern for the aircraft, is configured to:

calculate an inbound leg starting point using the inbound leg course, the inbound leg duration, and the airspeed;

calculate an outbound turn portion of a curved path trajectory for the aircraft using the airspeed for the aircraft, the wind speed, the wind direction, and a rate-of-turn for the aircraft, wherein the curved path trajectory is a path the aircraft will fly when the aircraft turns at the rate-of-turn and at the airspeed when the aircraft is subjected to the wind speed and the wind direction, and wherein the outbound turn portion intersects the holding fix such that the inbound course is tangent to the outbound turn portion at the holding fix;

calculate an inbound turn portion of the curved path trajectory for the aircraft using the airspeed for the aircraft, the wind speed, the wind direction, and the rate-of-turn for the aircraft, wherein the inbound turn portion does not intersect the outbound turn portion, and wherein the inbound turn portion intersects the inbound leg starting point such that the inbound leg course is tangent to the inbound turn portion at the inbound leg starting point; and determine the outbound leg for the holding pattern, wherein the outbound leg is a line that is tangent to both the outbound turn portion and the inbound turn portion and is not the same as the inbound leg.

28. The aircraft of claim 20, wherein the FAA protected airspace lateral limits are defined by the FAA holding pattern protected airspace template limits.

* * * * *

UNITED STATES PATENT AND TRADEMARK OFFICE

CERTIFICATE OF CORRECTION

PATENT NO. : 9,002,628 B2
APPLICATION NO. : 14/193542
DATED : April 7, 2015
INVENTOR(S) : Bruce Gary Wilder et al.

It is certified that error appears in the above-identified patent and that said Letters Patent is hereby corrected as shown below:

In the claims:

Column 31, Lines 11-16, Claim 19, should read:

-- 19. The computer program product of claim 11, wherein no part of the holding pattern is coincident with the holding pattern protected airspace limits, and wherein the holding pattern protected airspace limits are defined by a Federal Aviation Administration (FAA) holding pattern protected airspace template limits. --

Signed and Sealed this
Fifteenth Day of September, 2015

Michelle K. Lee

Michelle K. Lee
*Director of the United States Patent and Trademark Office*